US007149457B2

(12) United States Patent
Miyabe et al.

(10) Patent No.: US 7,149,457 B2
(45) Date of Patent: Dec. 12, 2006

(54) PROCESS CARTRIDGE AND ELECTROPHOTOGRAPHIC IMAGE FORMING APPARATUS

(75) Inventors: Shigeo Miyabe, Numazu (JP); Shinjiro Toba, Mishima (JP); Masaaki Sato, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 102 days.

(21) Appl. No.: 10/960,121

(22) Filed: Oct. 8, 2004

(65) Prior Publication Data

US 2005/0220486 A1 Oct. 6, 2005

(30) Foreign Application Priority Data

Mar. 31, 2004 (JP) ..... 2004-106511
Sep. 30, 2004 (JP) ..... 2004-289303

(51) Int. Cl.
*G03G 21/18* (2006.01)

(52) U.S. Cl. ..... 399/114; 399/207; 355/71

(58) Field of Classification Search ..... 399/110, 399/111, 112, 113, 114, 116, 117, 207; 355/71
See application file for complete search history.

(56) References Cited

U.S. PATENT DOCUMENTS

| | | | | |
|---|---|---|---|---|
| 5,113,220 | A | 5/1992 | Kwak | 355/200 |
| 5,729,796 | A * | 3/1998 | Miura et al. | 399/114 |
| 5,749,027 | A * | 5/1998 | Ikemoto et al. | 399/113 |
| 5,926,666 | A * | 7/1999 | Miura et al. | 399/25 |
| 5,946,531 | A * | 8/1999 | Miura et al. | 399/111 |
| 5,950,047 | A * | 9/1999 | Miyabe et al. | 399/111 |
| 6,075,957 | A * | 6/2000 | Batori et al. | 399/114 |
| 6,104,894 | A * | 8/2000 | Sato et al. | 399/106 |
| 6,327,448 | B1 | 12/2001 | Sasaki | 399/111 |
| 6,351,620 | B1 * | 2/2002 | Miyabe et al. | 399/111 |
| 6,640,066 | B1 * | 10/2003 | Sato | 399/106 |

(Continued)

FOREIGN PATENT DOCUMENTS

| | | |
|---|---|---|
| EP | 0 793 151 A2 | 9/1997 |
| JP | 61-49359 | 4/1986 |
| JP | 2001-42753 | 2/2001 |
| KR | 2003-69895 | 8/2003 |
| KR | 2004-8930 | 1/2004 |

*Primary Examiner*—David M. Gray
*Assistant Examiner*—Geoffrey T Evans
(74) *Attorney, Agent, or Firm*—Fitzpatrick, Cella, Harper & Scinto

(57) ABSTRACT

A process cartridge detachably mountable to a main assembly of an electrophotographic image forming apparatus, the process cartridge includes an electrophotographic photosensitive drum; process means actable on the electrophotographic photosensitive drum; a cartridge frame; a drum shutter movable between a close position in which the drum shutter covers an exposed portion of the electrophotographic photosensitive drum which is exposed through the cartridge frame and an open position in which drum shutter is retracted from the close position to expose the portion of the electrophotographic photosensitive drum, the drum shutter having a first shutter portion rotatably supported on the cartridge frame and a second rotatably supported on the cartridge frame, wherein in the close position, the first shutter portion covers an upstream side of the exposed portion with respect to an opening direction in which the drum shutter moves from the close position to the open position, and the second shutter portion covers a downstream side of the exposed portion with respect to the opening direction, and wherein in the open position, the first shutter portion and the second shutter portion are overlapped with each other in the widthwise direction of the drum shutter.

20 Claims, 15 Drawing Sheets

U.S. PATENT DOCUMENTS

| | | | | |
|---|---|---|---|---|
| 6,947,686 | B1 | 9/2005 | Kawai et al. | 399/111 |
| 2003/0039484 | A1* | 2/2003 | Naito et al. | 399/113 |
| 2003/0156856 | A1* | 8/2003 | Arimitsu et al. | 399/114 |
| 2003/0185587 | A1 | 10/2003 | Kawai et al. | 399/111 |
| 2003/0215257 | A1* | 11/2003 | Karakama et al. | 399/90 |
| 2005/0185984 | A1* | 8/2005 | Arimitsu et al. | 399/114 |

* cited by examiner

PROCESS CARTRIDGE AND ELECTROPHOTOGRAPHIC IMAGE FORMING APPARATUS

FIELD OF THE INVENTION AND RELATED ART

The present invention relates to a process cartridge and an electrophotographic image forming apparatus.

Here, an electrophotographic image forming apparatus is an apparatus for forming an image on a recording medium (for example, paper, OHP sheet, etc.) with the use of one of the electrophotographic image forming methods. For example, it includes an electrophotographic copying machine, an electrophotographic printer (for example, laser printer, LED printer, etc.), a facsimile apparatus, a word processor, a combination of two or more of the preceding machines (multifunction printer, etc.), etc.

A process cartridge means a cartridge which is removably mountable in the main assembly of an image forming apparatus, and in which a minimum of one among a charging means, a developing means, and a cleaning means, as processing means, and an electrophotographic photosensitive drum, are integrally placed so that they can be removably mountable in the main assembly of an image forming apparatus. It also includes a cartridge which is removably mountable in the main assembly of an electrophotographic image forming apparatus, and in which a minimum of a developing means as a processing means, and an electrophotographic photosensitive drum, are integrally placed so that they can be removably mountable in the main assembly of an electrophotographic image forming apparatus.

The technologies for compactly retracting a drum shutter by making a drum shutter from two or more sections have long been known.

For example, there is a description of a cartridge equipped with a shutter comprising first and second movable portions, in Japanese Laid-open U.M. Application 61-49359.

According to this application, however, the second portion 34 of the shutter is held to the cartridge frame by an arm 24 which is attached to the cartridge frame so that it can be rotated about the arm supporting portion 25. Thus, when the second portion 34 of the shutter is opened, it fits into the connective groove 35*b* of the first portion 35 of the shutter, and slides, and then, the second portion 35 of the shutter fits into the connective grooves 26 with which the cartridge frame is provided, and slides. In other words, the cartridge frame needs to be provided with the connective grooves 26 in addition to the arm supportive portion 25. Further, the distance which the arm 24 must travel is substantial. Thus, the employment of the shutter design disclosed in the aforementioned patent application makes it necessary to increase in size a process cartridge as well as an image forming apparatus.

Japanese Laid-open Patent Application 2001-042753 discloses another drum shutter having two sections. According to this application, the shutter is structured so that the two sections open in the opposing directions. This structural arrangement, however, complicates the mechanism for opening or closing the shutter. In addition, two spaces into which two sections of the shutter are individually retracted are required per photosensitive drum. Thus, the employment of this shutter design also results in increase in cartridge size and image forming apparatus size.

Thus, the present invention is for solving the above described problems of the prior art.

SUMMARY OF THE INVENTION

The primary object of the present invention is to provide a process cartridge, the electrophotographic photosensitive drum of which is perfectly covered by the first and second sections of the drum shutter of the cartridge, and an electrophotographic image forming apparatus compatible with such a process cartridge.

Another object of the present invention is to provide a process cartridge which is smaller in the space necessary for its drum shutter to move between the closed position and open position, being therefore smaller than a process cartridge in accordance with the prior art, and an electrophotographic image forming apparatus compatible with such a process cartridge.

Another object of the present invention is to provide a process cartridge, the drum shutter of which is compactly retracted into the main assembly of an electrophotographic image forming apparatus as the drum shutter is moved into the open position in which it exposes the electrophotographic photosensitive drum from the cartridge frame, and an electrophotographic image forming apparatus compatible with such a process cartridge.

According to an aspect of the present invention, there is provided a process cartridge detachably mountable to a main assembly of an electrophotographic image forming apparatus, the process cartridge comprising an electrophotographic photosensitive drum; process means actable on the electrophotographic photosensitive drum; a cartridge frame; a drum shutter movable between a close position in which the drum shutter covers an exposed portion of the electrophotographic photosensitive drum which is exposed through the cartridge frame and an open position in which the drum shutter is retracted from the close position to expose the portion of the electrophotographic photosensitive drum, the drum shutter having a first shutter portion rotatably supported on the cartridge frame and a second rotatably supported on cartridge frame, wherein in the close position, the first shutter portion covers an upstream side of the exposed portion with respect to an opening direction in which the drum shutter moves from the close position to the open position, and the second shutter portion covers a downstream side of the exposed portion with respect to the opening direction, and wherein in the open position, the first shutter portion and the second shutter portion are overlapped with each other in the widthwise direction of the drum shutter.

According to another aspect of the present invention, there is provided an electrophotographic image forming apparatus for forming an image on a recording material, wherein a process cartridge is detachably mountable to the electrophotographic image forming apparatus, the electrophotographic image forming apparatus comprising (a) mounting means for detachably mounting a process cartridge, the process cartridge including, an electrophotographic photosensitive drum; process means actable on the electrophotographic photosensitive drum; a drum shutter movable between a close position in which the drum shutter covers an exposed portion of the electrophotographic photosensitive drum which is exposed through the cartridge frame and an open position in which drum shutter is retracted from the close position to expose the portion of the electrophotographic photosensitive drum, the drum shutter having a first shutter portion rotatably supported on the cartridge frame and a second rotatably supported on the cartridge frame, wherein in the close position, the first shutter portion covers an upstream side of the exposed portion with respect to an opening direction in which the drum shutter moves from the close position to the open position, and the second shutter portion covers a downstream side of the exposed portion with respect to the opening direction, and wherein in the open position, the first shutter portion and the second shutter portion are overlapped with each other in the widthwise direction of the drum shutter; and (b) feeding means for feeding the recording material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the process cartridge and electrophotographic image forming apparatus in accordance with the present invention will be described.

Embodiment 1

Figure 1:
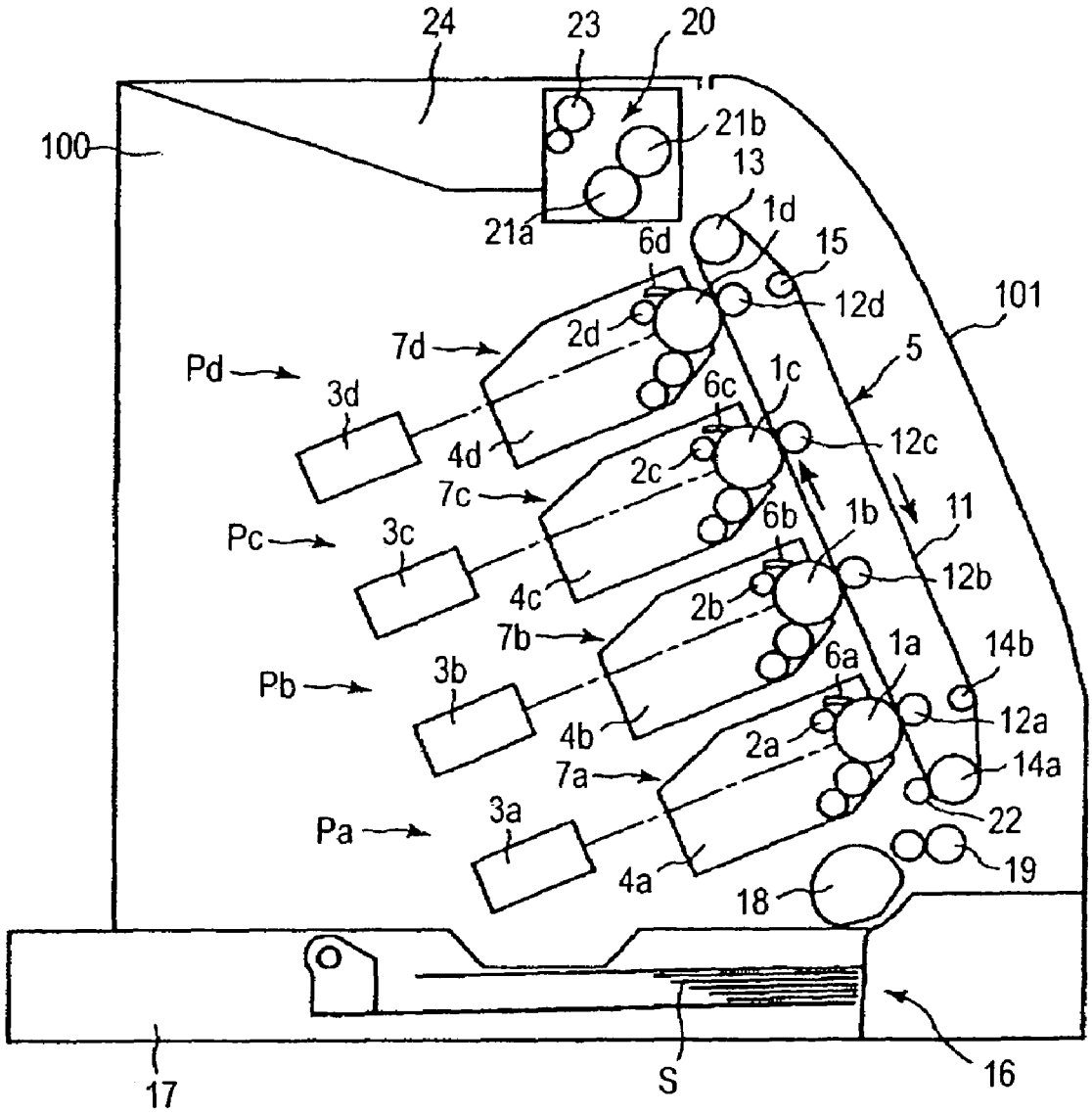
FIG. 1 is a schematic sectional view of the image forming apparatus in the first embodiment of the present invention, showing the general structure thereof.

FIG. 1 shows the general structure of the electrophotographic color image forming apparatus in the first embodiment of the present invention. First, the general structure of this electrophotographic image forming apparatus will be described with reference to FIG. 1.

(General Structure of Image Forming Apparatus)

Referring to FIG. 1, the image forming apparatus in this embodiment is a full-color laser beam printer as an electrophotographic image forming apparatus. The main assembly 100 of this printer has a plurality of image forming stations (four image forming stations Pa, Pb, Pc, and Pd, in this embodiment), which are vertically stacked in parallel. Each of the image forming stations Pa, Pb, Pc, and Pd is provided with a cartridge mounting means (unshown) so that a process cartridge (which hereinafter will be referred to simply as cartridge) 7 (7*a*, 7*b*, 7*c*, or 7*d*) can be removably mounted.

Precisely speaking, in this embodiment, the image formation stations Pa, Pb, Pc, and Pd are stacked in the direction slightly angled relative to the true vertical direction. However, they do not need to be stacked in the slightly angled direction; they may be stacked in the truly vertical direction.

Each of the cartridges 7 (7*a*, 7*b*, 7*c*, and 7*d*) is provided with an electrophotographic photosensitive drum (which hereinafter will be referred to simply as a photosensitive drum) 1 (1*a*, 1*b*, 1*c*, and 1*d*). The photosensitive drum 1 is rotationally driven by a driving means (unshown) in the clockwise direction of the drawing. In the adjacencies of the peripheral surface of the photosensitive drum 1, there are a charging means 2 (2*a*, 2*b*, and 2*d*) for uniformly charging the peripheral surface of the photosensitive drum 1, a scanner unit (3*a*, 3*b*, 3*c*, and 3*d*) for projecting a beam of laser light, while modulating the beam of laser light with image formation data, onto the peripheral surface of the photosensitive drum 1 to form an electrostatic latent image on the peripheral surface of the photosensitive drum 1, a developing means (4*a*, 4*b*, 4*c*, and 4*d*) for developing the latent image into a visible image (formed of toner) by adhering toner to the latent image, a transferring apparatus 5 for transferring the toner image on the photosensitive drum 1 onto a recording medium S, and a cleaning means 6 (6*a*, 6*b*, 6*c*, and 6*d*) for removing the toner remaining on the peripheral surface of the photosensitive drum 1 after the transfer of the toner image, listing in the order of the image formation steps they are involved.

In this embodiment, the photosensitive drum 1, charging means (processing means) 2, developing means (processing means), and cleaning means (processing means) 6 are integrally placed in a cartridge removably mountable in the main assembly of the image forming apparatus, constituting the process cartridge 7.

Next, referring to FIG. 2, the essential components in the process cartridge 7 will be described in more detail, starting from the photosensitive drum 1.

The photosensitive drum 1 (1*a*, 1*b*, 1*c*, and 1*d*) comprises a cylinder, and a layer of photosensitive substance coated on the peripheral surface of the cylinder. The photosensitive drum 1 is rotatably supported by a pair of supporting members, by its lengthwise ends. To one of the lengthwise ends of the photosensitive drum 1, the driving force from a motor (unshown) is transmitted to rotationally drive the photosensitive drum 1 in the counterclockwise direction.

The charging means 2 (2*a*, 2*b*, 2*c*, and 2*d*) uses a contact charging method. The charging means 2 is an electrically conductive roller, the peripheral surface of which is placed in contact with the peripheral surface of the photosensitive drum 1. The peripheral surface of the photosensitive drum 1 is uniformly charged by applying a charge bias voltage to the roller 2.

The scanner unit (3*a*, 3*b*, 3*c*, and 3*d*) comprises a laser diode (unshown), a polygon mirror which is rotated at a high speed (unshown), an image formation lens (unshown), etc. A beam of image formation light modulated with video signals is projected from the laser diode, deflected (reflected) by the polygon mirror being rotated at a high speed, and focused on the charged peripheral surface of the photosensitive drum 1 through the image formation lens. As a result, numerous points of the charged peripheral surface of the photosensitive drum 1 are selectively exposed, forming an electrostatic latent image, which reflects the video signals, on the peripheral surface of the photosensitive drum 1.

The scanner unit 3 (3*a*, 3*b*, 3*c*, and 3*d*) comprises a laser diode (unshown), a polygon mirror which is rotated at a high speed (unshown), an image formation lens (unshown), etc. A beam of image formation light modulated with video signals is projected from the laser diode, deflected (reflected) by the polygon mirror being rotated at a high speed, and focused on the charged peripheral surface of the photosensitive drum 1 through the image formation lens. As a result, numerous points of the charged peripheral surface of the photosensitive drum 1 are selectively exposed, forming an electrostatic latent image, which reflects the video signals, on the peripheral surface of the photosensitive drum 1.

The developing means (4*a*, 4*b*, 4*c*, and 4*d*) have a toner container 41 in which toners of yellow, magenta, cyan, or black color, is stored, respectively. The developing means sends the toner in the toner container 41 to the toner supply roller 43, by the toner moving mechanism 42.

The toner supply roller 43 is rotated in the clockwise direction indicated by an arrow mark to supply the development roller 40, as a developer bearing member, with toner, and also, to strip from the development roller 40 the toner remaining on the development roller 40 after the development of the latent image on the photosensitive drum 1.

After being supplied to the development roller 40, the toner is coated, while being triboelectrically charged, by the development blade 44 kept pressed upon the peripheral surface of the development roller 40, on the peripheral surface of the development roller 40 (which is being rotated in the direction indicated by an arrow mark Y). Then, as the development bias is applied to the development roller 40, the peripheral surface of which is opposing the peripheral surface of the photosensitive drum 1 on which the latent image has just been formed, the toner is adhered to the peripheral surface of the photosensitive drum 1 in the pattern of the latent image; the latent image is developed by the toner.

The transferring apparatus 5 is provided with the electrostatic transfer belt 11, which is circularly driven, with the outward surface of which remaining in contact with all of the photosensitive drums 1 (1*a*, 1*b*, 1*c*, and 1*d*). The electrostatic transfer belt 11 is wrapped and stretched around the driver roller 13, follower rollers 14*a* and 14*b*, and tension roller 15. It electrostatically holds the recording medium S to the outward surface thereof (surface on the left side in the drawing), and is circularly driven to place the recording medium S in contact with the peripheral surface of each photosensitive drum 1. With this movement of the electrostatic transfer belt 11, the recording medium S is conveyed by the transfer belt 11 to the transfer station in which the toner image on the photosensitive drum 1 is transferred onto the recording medium S.

Within the loop formed by the transfer belt 11, four transfer rollers (12*a*, 12*b*, 12*c*, and 12*d*) are placed in the positions in which they oppose the four photosensitive drums 1 (1*a*, 1*b*, 1*c*, and 1*d*), respectively, and remain in contact with the inward surface of the transfer belt 11, in terms of the loop. To these transfer rollers 12, bias is applied during the transfer process, and therefore, electrical charge is applied to the recording medium S through the transfer belt 11, generating an electric field. By this electric field, the toner images on the photosensitive drums 1 are transferred onto the recording medium S while the recording medium S is in contact with each of the photosensitive drums 1.

The recording medium feeding station 16 is the station from which the recording medium S is conveyed to each image forming station (Pa, Pb, Pc, and Pd). It has a cassette 17 in which a plurality of recording mediums S are stored. During an image forming operation, the feed roller (semi-cylindrical roller) 18, and a pair of registration rollers 19, are rotationally driven in synchronism with the progression of the image forming operation, feeding the recording mediums S into the apparatus main assembly, while separating them one by one. Each recording medium S is temporarily kept on standby, remaining slightly bowed upward, by the registration roller 19, as its leading edge comes into contact with the registration rollers 19. Then, it is released in synchronism with the rotation of the transfer belt 11 and the leading edge of the image formed on the photosensitive drum 1, and then, is conveyed to the transfer belt 11, by the pair of registration rollers 19.

The fixation station 20 is the station in which the plurality of toner images which are different in color and have just been transferred onto the recording medium S are fixed to the recording medium S. The fixation station 20 comprises: a rotational heat roller 21*a*, and a pressure roller 21*b* kept pressed against the heat roller 21*a* to apply heat and pressure to the recording medium S. More specifically, the recording medium S onto which the toner images have been just transferred from the photosensitive drums 1 is conveyed through the fixing station 20 by the pressure roller 21*b*, and while the recording medium S is conveyed through the fixation station 20, heat and pressure is applied to the recording medium S by the heat roller 21*a*, causing the plurality of toner images different in color to be fixed to the surface of the recording medium S.

As for the image forming operation, first, the cartridges 7 (7*a*, 7*b*, 7*c*, and 7*d*) are sequentially driven in synchronism with the image formation timing, rotating sequentially the photosensitive drums 1 (1*a*, 1*b*, 1*c*, and 1*d*) in the counterclockwise direction, and the scanner units, which correspond to the cartridges 7 one for one, are sequentially driven. As the photosensitive drum 1 is driven, the charge roller 2 uniformly charges the peripheral surface of the photosensitive drum 1, and the scanner unit exposes the peripheral surface of the photosensitive drum 1 in response to video signals, forming thereby an electrostatic latent image on the peripheral surface of the photosensitive drum 1. Each of the development rollers 40 in the developing means forms a toner image (image formed of toner) on the peripheral surface of the photosensitive drum 1 by transferring toner onto the numerous points of the electrostatic latent image, which are lower in potential level (it develops electrostatic latent image).

Meanwhile, the registration rollers 19 begin to be rotated, conveying the recording medium S to the transfer belt 11, so that the timing with which the leading edge, in terms of the moving direction of the transfer belt 11, of the toner image formed on the peripheral surface of the most upstream photosensitive drum 1 is brought to the contact area between the photosensitive drum 1 and transfer belt 11, by the rotation of the photosensitive drum 1, coincides with the timing with which the theoretical line on the recording medium S, at which the transfer of the toner images onto the recording medium S is to begin, is brought to the contact area.

The recording medium S is pressed upon the outward surface of the transfer belt 11 by an adhesion roller 22, while remaining pinched between the adhesion roller 22 and transfer belt 11. In addition, electrical voltage is applied between the transfer belt 11 and roller 22, inducing an electrical charge between the recording medium S, which is a dielectric medium, and the dielectric layer of the transfer belt 11, electrostatically adhering the recording medium S to the outward surface of the transfer belt 11. Therefore, it is assured that the recording medium S is adhered to the transfer belt 11, and remains adhered thereto until it is conveyed to the most downstream transfer station.

While the recording medium S is conveyed as described above, the toner image on each of the photosensitive drums 1 is sequentially transferred onto the recording medium S by the electric field formed between the photosensitive drum 1 and transfer roller 12.

After the transfer of the four toner images different in color onto the recording medium S, the recording medium S is separated from the transfer belt 11 by the curvature of the driver roller 13, and is conveyed into the fixation station 20, in which the aforementioned toner images are thermally fixed to the recording medium S. Then, the recording medium S is discharged from the apparatus main assembly by a pair of discharge rollers 23 through the recording medium outlet 24, with the image bearing surface facing downward.

(Structure of Process Cartridge)

Next, referring to FIG. 2. and FIGS. 3(*a*) and 3(*b*), the process cartridge in accordance with the present invention will be described.

Figure 2:
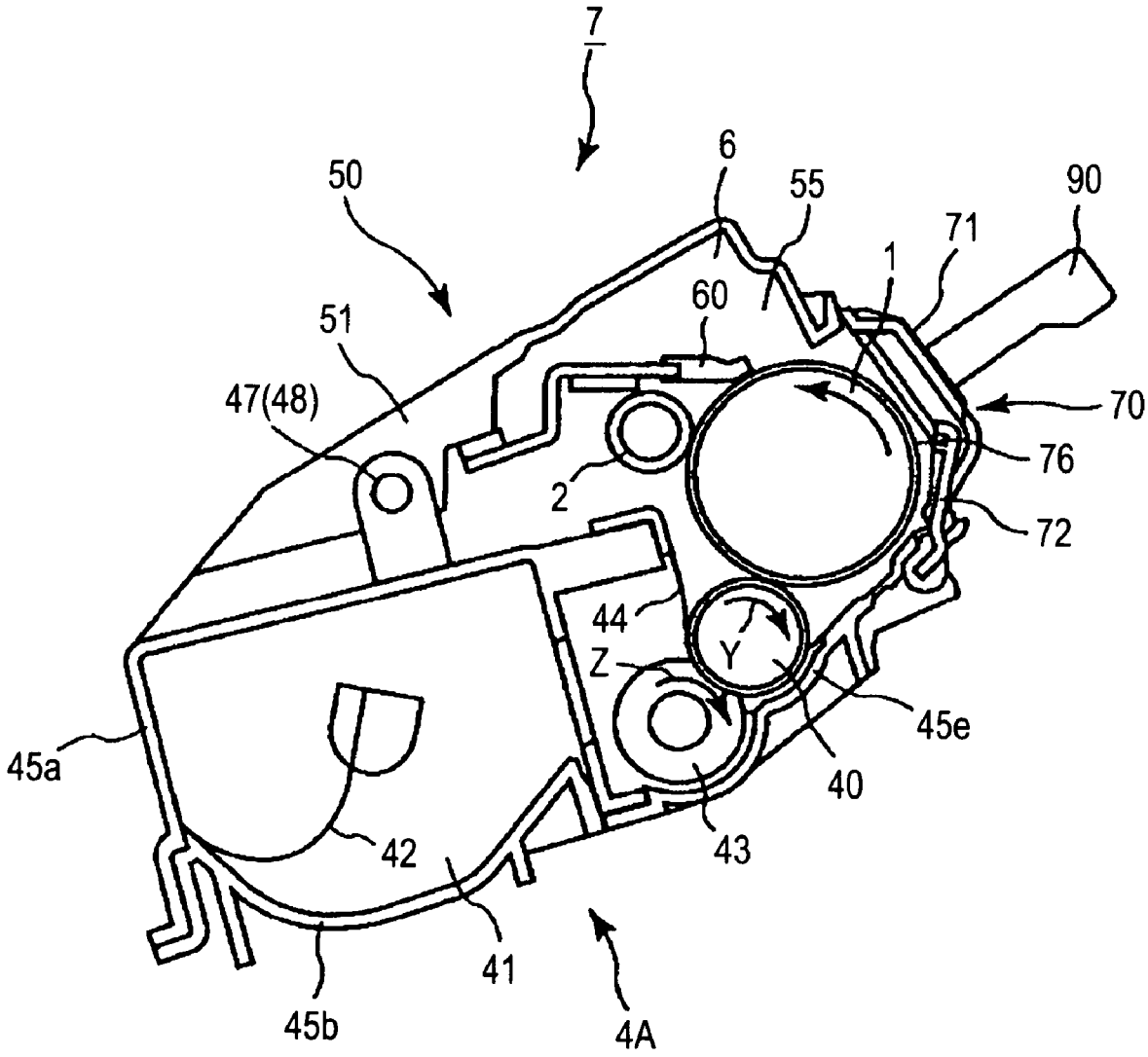
FIG. 2 is a schematic sectional view of the process cartridge in the first embodiment of the present invention.
Figure 3:
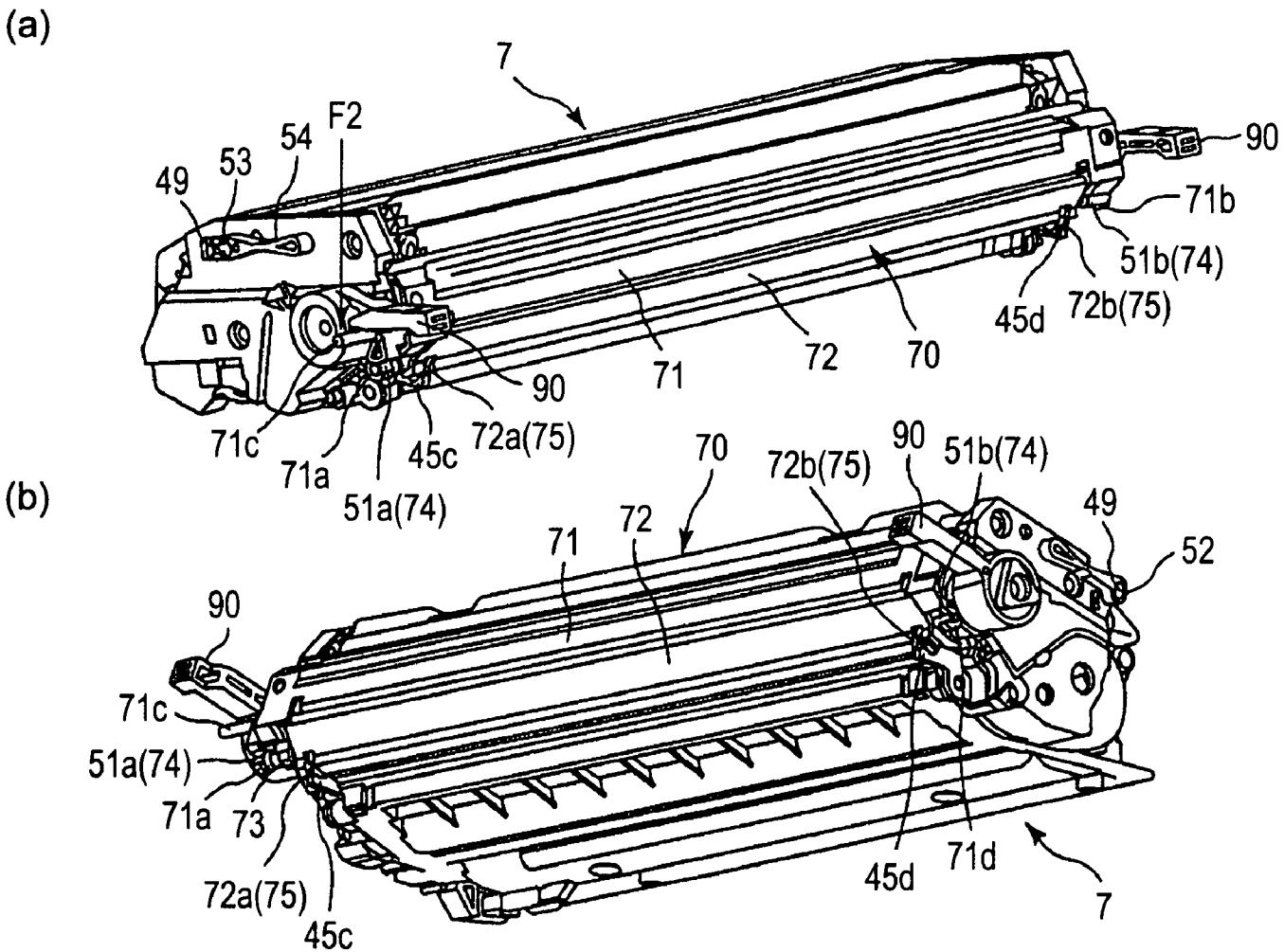
FIG. 3(*a*) is a perspective view of the process cartridge as seen from diagonally above one of the front corners of the cartridge, and FIG. 3(*b*) is a perspective view of the process cartridge as seen from diagonally below the other front corner of the process cartridge.

FIG. 2 is a sectional view of the cartridge 7 which contains the toner, at a plane perpendicular to the lengthwise direction of the cartridge 7, and FIG. 3 is a perspective view of the cartridge 7 shown in FIG. 2. The cartridges 7*a*, 7*b*, 7*c*, and 7*d* which contain yellow, magenta, cyan, and black toners, respectively, are the same in structure.

The above described components are integrally attached to the cartridge frame, or they are integral parts of the cartridge frame. The cartridge in this embodiment has a cleaner unit 50 having the photosensitive drum 1, charging means 2, and cleaning means 6, and a development unit 4A having the developing means for developing the electrostatic latent image formed on the peripheral surface of the photosensitive drum 1.

The cartridge frame in this embodiment has a cleaner unit frame 51 and a development unit frame. To the cleaner unit frame 51 which is a part of the cleaner unit 50, the photosensitive drum 1 is rotatably attached with a pair of bearings (unshown) placed between the photosensitive drum 1 and frame 51.

In the adjacencies of the peripheral surface of the photosensitive drum 1, the charging means 2 for uniformly charging the photosensitive layer, that is, the outermost layer, of the photosensitive drum 1, and the cleaning blade 60 (which hereinafter will be referred to simply as blade 60) for removing the developer (residual toner) remaining on the peripheral surface of the photosensitive drum 1 after the image transfer, are placed; they are placed in contact with the peripheral surface of the photosensitive drum 1. After being removed from the peripheral surface of the photosensitive drum 1 by the blade 60, the residual toner (removed toner) is stored in the removed toner storage chamber 55, which is an integral part of the cleaning means frame 51.

The development unit 4A has a development unit frame (made up of sub-frames 45*a*, 45*b* and 45*e*) in which toner is stored.

The development roller 40 is supported by the development unit frame, with the interposition of a pair of bearings, so that the development roller 40 is rotatable (direction indicated by arrow mark Y) with the presence of a minute gap between the peripheral surfaces of the development roller 40 and photosensitive drum 1. The development unit frame also holds the developer supply roller 43 and the development blade 44, which are placed in contact with the peripheral surface of the development roller 40. The developer supply roller 34 is rotated in contact with the peripheral surface of the development roller 40 (in the direction indicated by arrow mark Z). The development unit frame also holds the toner conveyance mechanism 42, which is placed within the development unit frame to convey the stored toner to the supply roller 43 while stirring the toner.

The development unit 4A is provided with a pair of connective holes 47 and 48, which are located at the lengthwise ends of the development unit frame, one for one, whereas the cleaner unit frame 51 of the cleaner unit 50 is provided with a pair of supportive holes 52 and 53, which are located at the longitudinal ends of the cleaner unit frame 51. The development unit 4A and the cleaner unit 50 are connected to each other by inserting, from the outward of the two units, a pair of pins 49 through the connective holes 47 and 48 and supportive holes 52 and 53 while holding the two units so that the connective holes 47 and 48 and supportive holes 52 and 53 align one for one. As a result, the entirety of the development unit 4A becomes rotatable about the pins 49, being thereby movable relative to the cleaner unit 50.

Further, the development unit 4A is kept pressured by a pair of springs (unshown) in the direction to rotate the development unit 4A about the axial lines of the supportive holes 52 and 53 so that the development roller 40 is kept in contact with the photosensitive drum 1.

During a developing operation, the toner in the toner container 41 is conveyed by the stirring mechanism 42 to the supply roller 43. As a result, the peripheral surface of the supply roller 43 is rubbed against the peripheral surface of the development roller 40, causing the toner on the peripheral surface of the supply roller 43 to be supplied (adhered) to the peripheral surface of the development roller 40. The toner having adhered to the peripheral surface of the development roller 40 is brought by the rotation of the development roller 40 to the development blade 44. Thus, the layer of the toner on the peripheral surface of the development roller 40 is regulated in thickness by the development blade 44, into a thin layer of the toner uniform in thickness, while being given a predetermined amount of electric charge.

Then, the thin layer of the toner on the peripheral surface of the development roller 40 is brought by the further rotation of the development roller 40 to the development station, in which the distance between the photosensitive drum 1 and development roller 40 is extremely small. In the development station, the toner from the thin layer of the toner on the peripheral surface of the development roller 40 is adhered to the electrostatic latent image on the peripheral surface of the photosensitive drum 1, by the development bias applied to the development roller 40 from the electrical power source (unshown); in other words, the development roller 40 develops the latent image. The toner which did not contribute to the development of the latent image, that is, the toner remaining on the development roller 40 after the image transfer, is returned by the further rotation of the development roller 40, into the development unit frame, in which it is stripped from the development roller 40 by the supply roller 43 in the area in which the peripheral surfaces of the supply roller 43 and development roller 40 are rubbing against each other; in other words, the residual toner is recovered into the development unit frame. The recovered toner is mixed into the toner in the development unit frame by the stirring mechanism 42.

(Method for Mounting Process Cartridge into Image Forming Apparatus Main Assembly and Removing it Therefrom)

Next, referring to FIG. 4 and FIGS. 10(*a*) and 10(*b*), the method for mounting the cartridge 7 into the apparatus main assembly 100 and removing it therefrom will be described.

Figure 4:
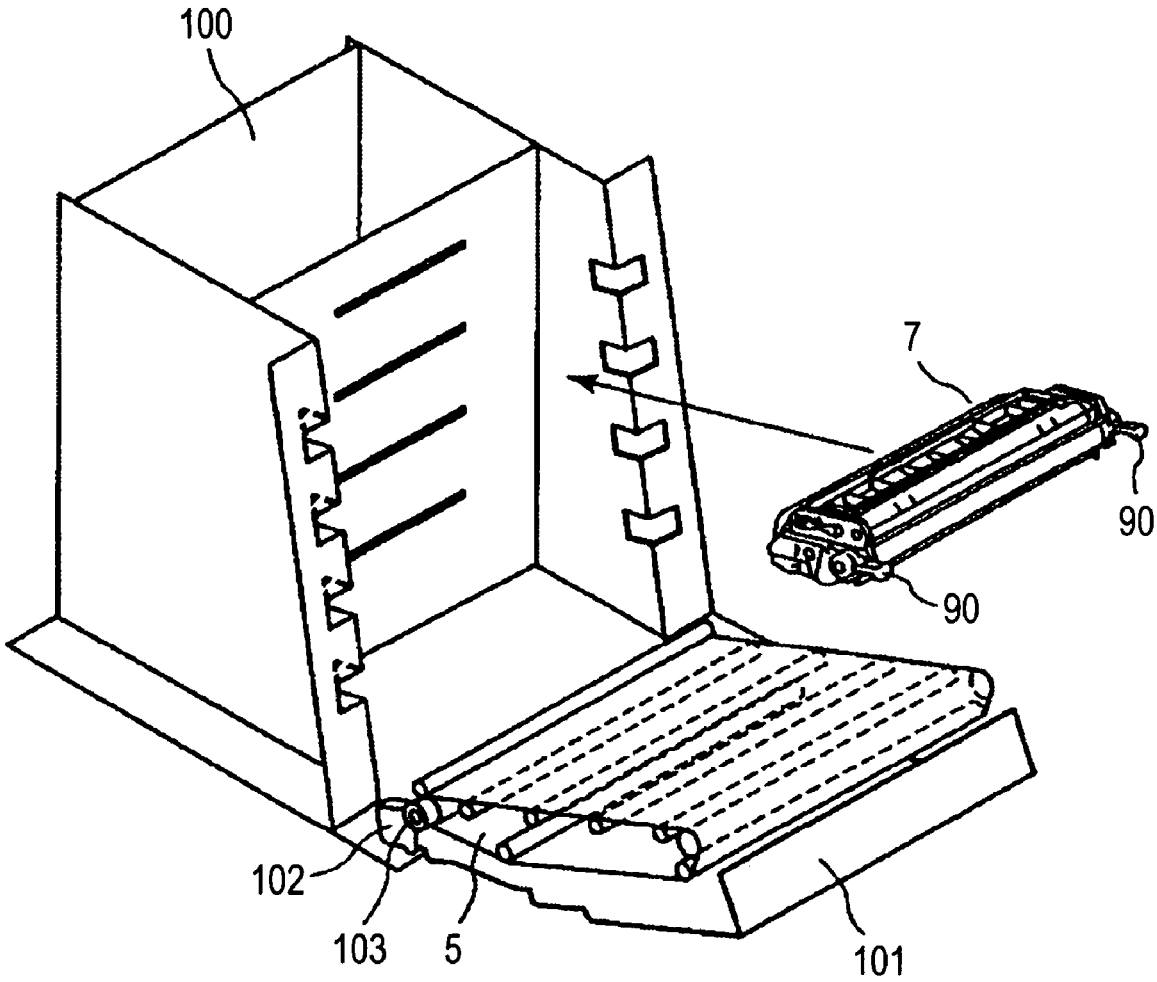
FIG. 4 is an exploded schematic perspective view of the image forming apparatus, showing the relationship among the main assembly of the image forming apparatus, process cartridge, hinged front cover of the main assembly, and electrostatic transferring apparatus.
Figure 10:
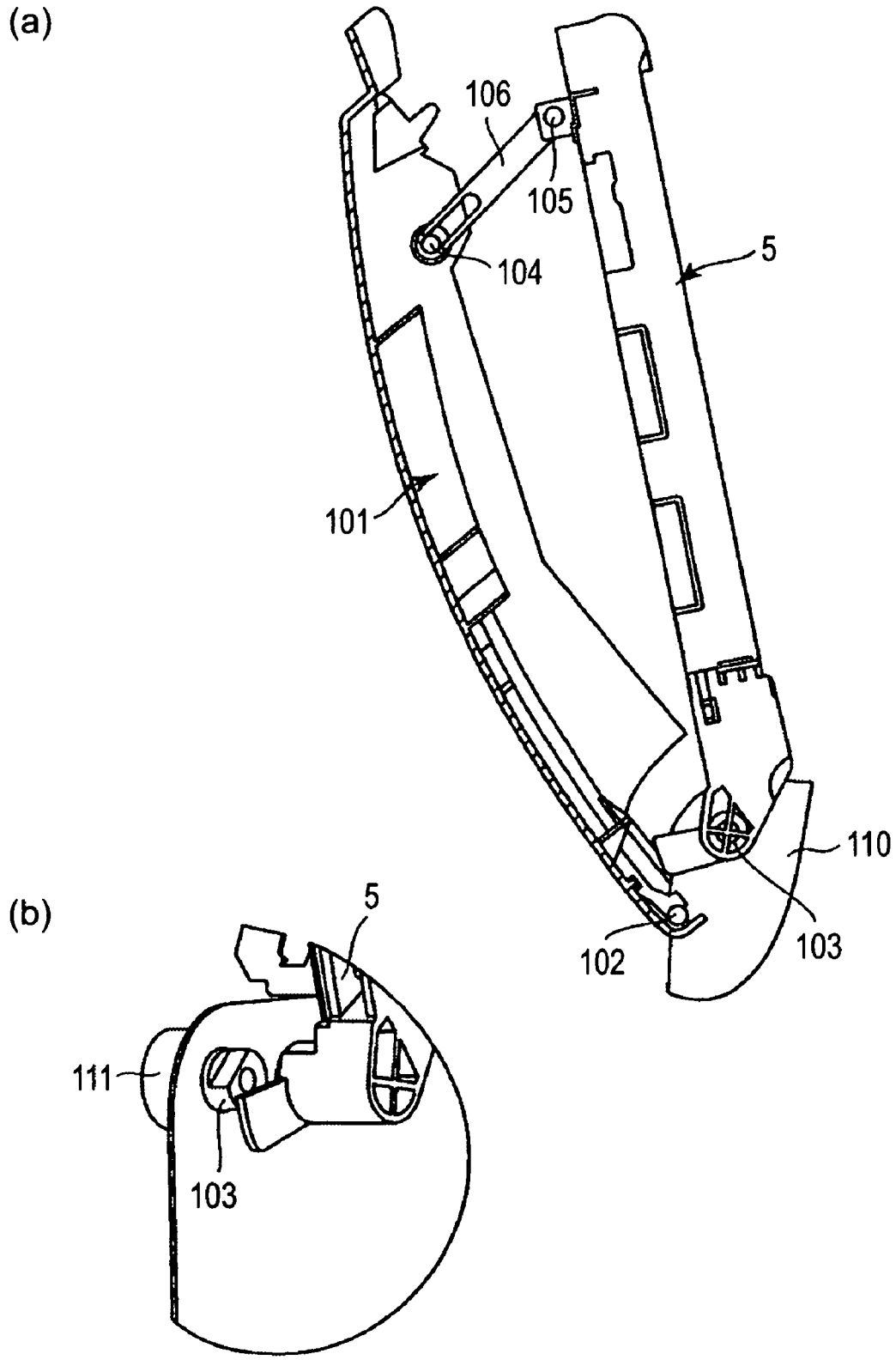
FIGS. 10(*a*) and 10(*b*) are schematic drawings for describing the linkage between the front cover and the electrostatic transferring apparatus.

Referring to FIG. 4 and FIGS. 10(*a*) and 10(*b*), the apparatus main assembly 100 is provided with a hinged door 101 (front cover). The door 101 is hinged to the apparatus main assembly 100 so that it can be rotated about the door supporting shaft 102. The apparatus main assembly 100 is also provided with a transferring apparatus 5, which is attached to the hinged door 101 with the use of a connective means (linkage), which will be described later in detail. Thus, as the hinged door 101 is opened or closed, the transferring apparatus 5 is also rotated about the door supporting shaft 102.

When the hinged door 101 is open, and therefore, the transferring apparatus 5 is away from the apparatus main assembly 100, the cartridge 7 can be mounted into the apparatus main assembly 100 or removed therefrom. The cartridge 7 is provided with a pair of handles 90, which can be grasped by an operator during the mounting or removal of the cartridge 7. The pair of handles 90 are located near the lengthwise ends of the cartridge, one for one, at which the photosensitive drum 1 is supported.

As the cartridge 7 is inserted into the apparatus main assembly 100, a pair of insertion guides 54 with which the cartridge 7 is provided engages with the a pair of guide rails (unshown) with which each of the image forming stations Pa, Pb, Pc, and Pd of the main assembly 100 of the image forming apparatus is provided. Therefore, as the cartridge 7 is removably mounted into the apparatus main assembly 100, it is precisely positioned relative to the apparatus main assembly 100; it is moved into a predetermined position in the apparatus main assembly 100.

(Structure of Drum Shutter)

Figure 6:
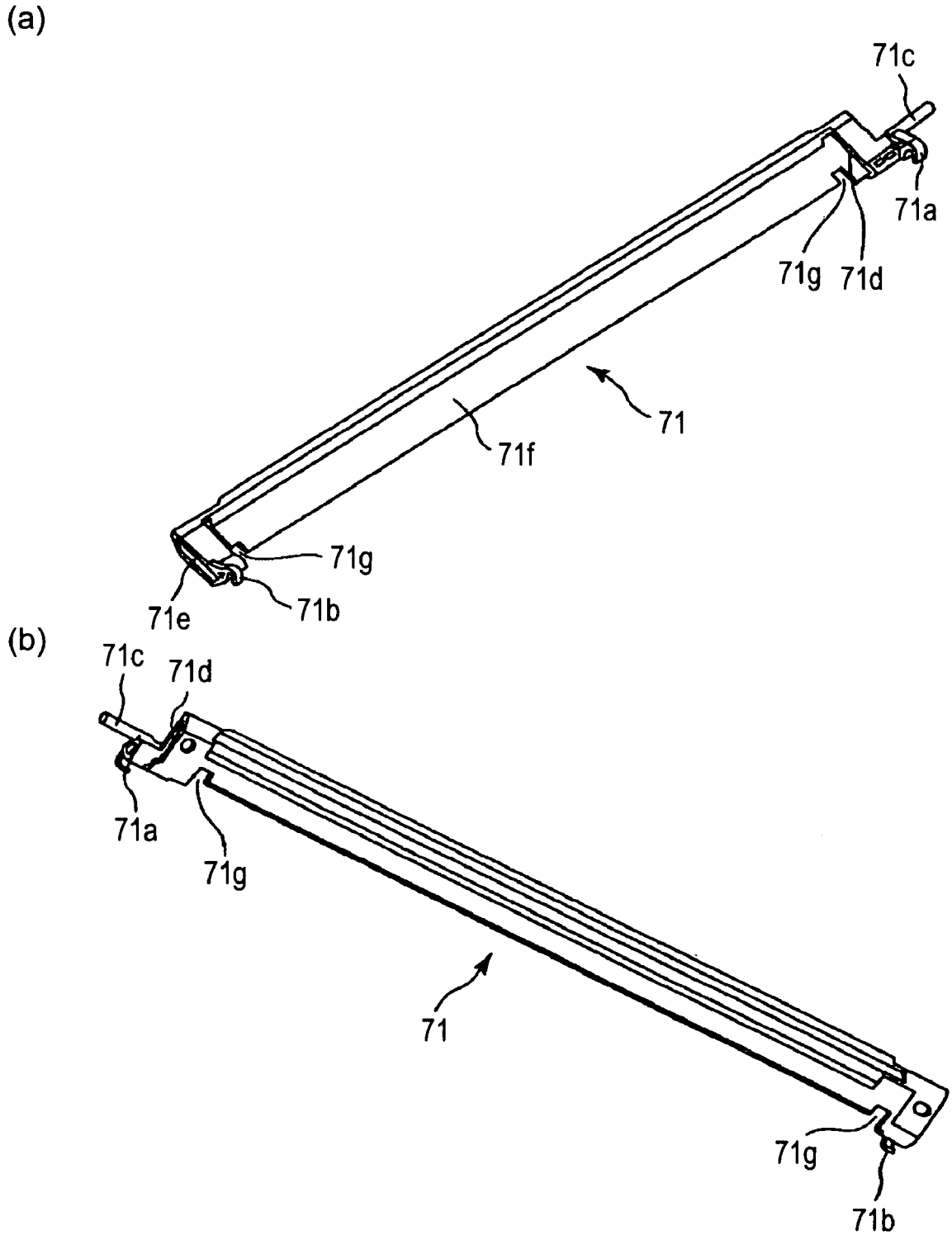
FIG. 6 is a perspective view of a first portion of the drum shutter.

Next, referring to FIGS. 2, 3(*a*), 3(*b*), 5, 6, 7, and 8(*a*)–8(*c*), the structure of the drum shutter will be described. FIGS. 6 an 7 are perspective views of the drum shutter.

Referring to FIG. 2, when the cartridge 7 is not in the apparatus main assembly 100, the exposure window 76 of the cartridge 7, through which the photosensitive drum 1 is exposed, remains covered with the drum shutter 70 to protect the photosensitive drum 1.

In this embodiment, the drum shutter 70 has a two-piece shutter. That is, it has first and second portions 71 and 72, respectively. The first shutter portion 71 covers the downstream side of the exposure window 76 in terms of the direction in which the photosensitive drum is rotated (upstream side in terms of the direction in which shutter 70 is opened), and the second shutter portion 72 covers the upstream side of the exposure window 76 (downstream side of shutter 70 in terms of the shutter opening direction). The main portions of the first and second shutter portions 71 and 72 are formed of a flat plate of resin, the thickness of which is in the range of 1–3 mm.

Figure 5:
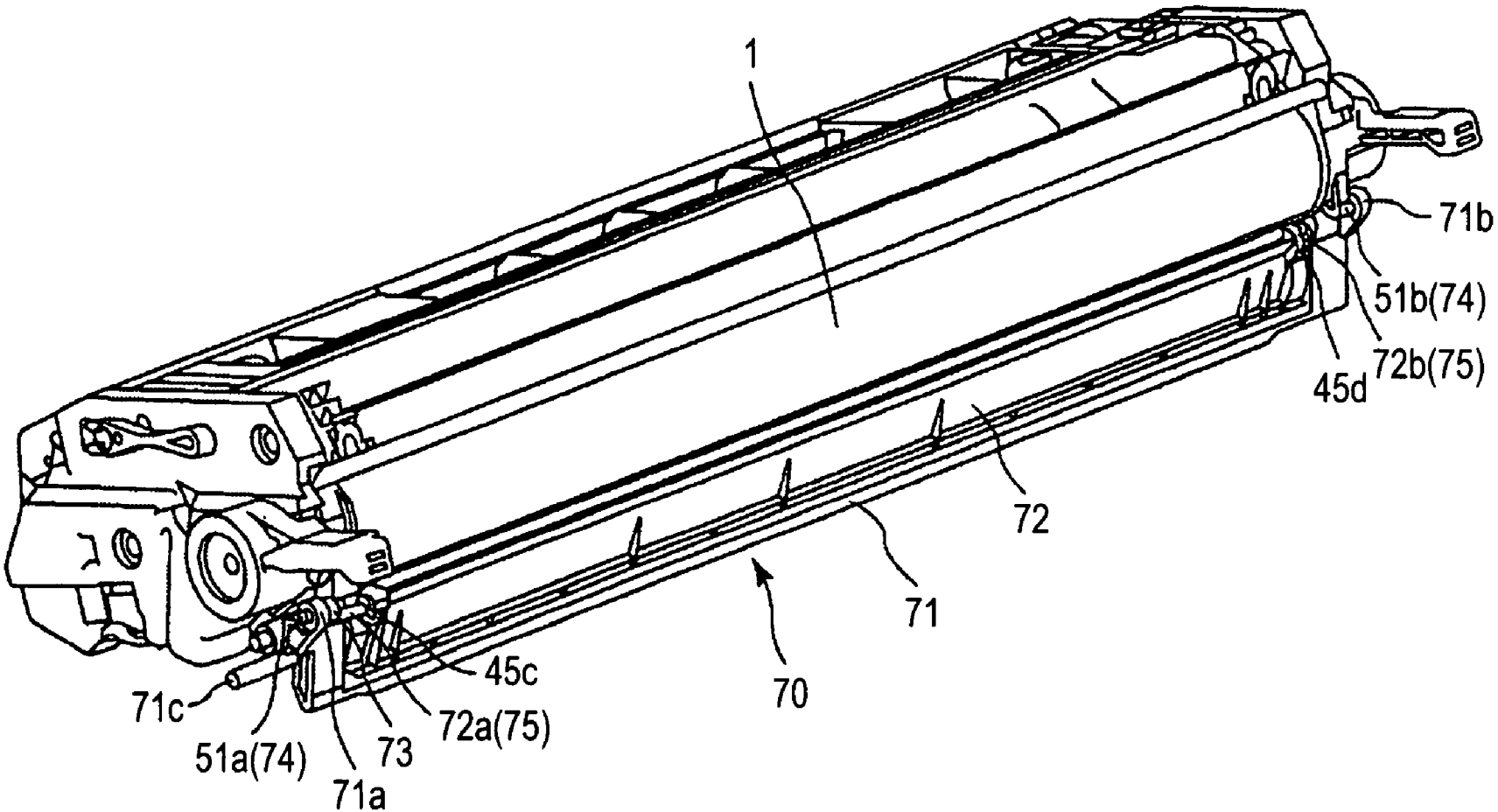
FIG. 5 is a perspective view of the process cartridge, the drum shutter of which is in the open position.
Figure 8:
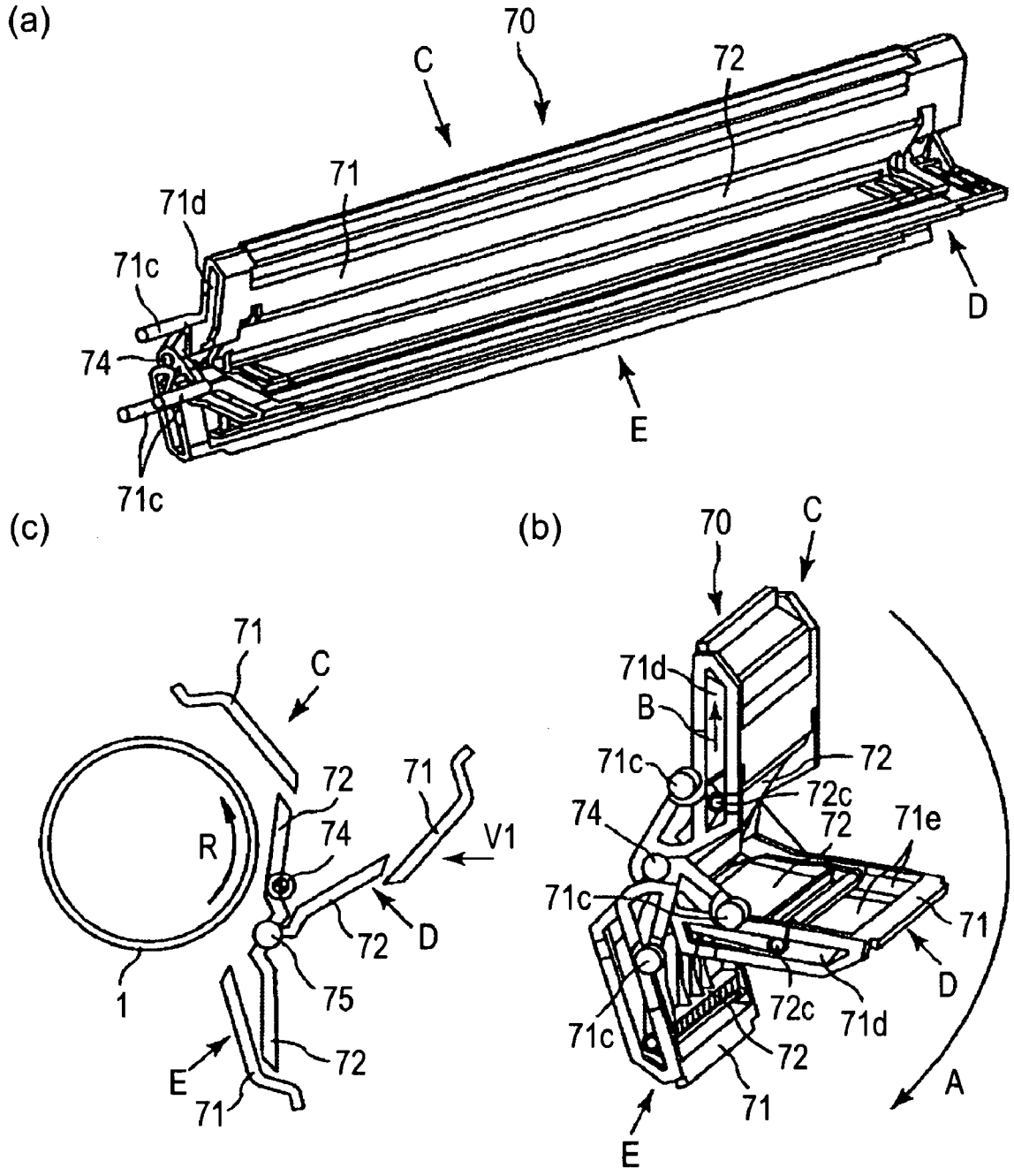
FIGS. 8(*a*)–8(*c*) are drawings for describing the structure and movements of the drum shutter in the first embodiment, FIG. 8(*a*) being a perspective view of the drum shutter, showing the general structure thereof, FIG. 8(*b*) being a perspective view of the drum shutter, showing the structure of one of the lengthwise ends thereof, and FIG. 8(*c*) being a schematic sectional view for showing the movements of the drum shutter.

Referring to FIG. 6, the first portion 71 of the shutter 70 has a pair of grooved portions 71*a* and 71*b* (which hereinafter will be referred to simply as grooves), which are located at the ends in terms of the lengthwise direction (parallel to axial direction of photosensitive drum 1), one for one, having a U shaped groove. Referring to FIGS. 3 and 5, these grooves 71*a* and 71*b* are were the pair of supporting shafts 51*a* and 51*b* of the cleaner unit frame 51 fit, allowing the first portion 71 of the shutter 70 to rotate about the axial line of the shaft 74, or the line connecting the center lines of the supporting shafts 51*a* and 51*b*. The first portion 71 of the shutter 70 is also provided with a pair of grooves 71*d* and 71*e*, which are located also at the lengthwise ends of the first portion 71, and are connected to the second portion 72 of the shutter 70 to regulate the movement of the second portion 72 when the shutter 70 is opened or closed. in other words, when the shutter 70 is opened or closed, the movement of the portion 72 of the shutter 70 is controlled by the connective groove 71*d* and 71*e* of the first portion 71 of the shutter 70. These connective grooves 71*d* and 71*e* are in the form of an elongated hole elongated in the widthwise direction of the first portion 71 of the shutter 70, and are open at least on the inward side (groove 71*e* side, in terms of lengthwise direction). In this embodiment, the connective grooves 71*d* and 71*e* are through holes elongated as shown in FIG. 8(*b*), which is a schematic drawing.

Further, the first portion 71 of the shutter 70 is provided with a pin 71*c*, which projects outward from one of the lengthwise ends of the first portion 71, in the lengthwise direction. This pin 71*c* is the portion by which the first portion 71 is pushed down by the shutter moving arm 202 (FIG. 12) of the apparatus main assembly 100, in the direction indicated by an arrow mark F2 in FIG. 3*a*, in order to open the drum shutter 70. This matter will be described later in more detail.

Figure 7:
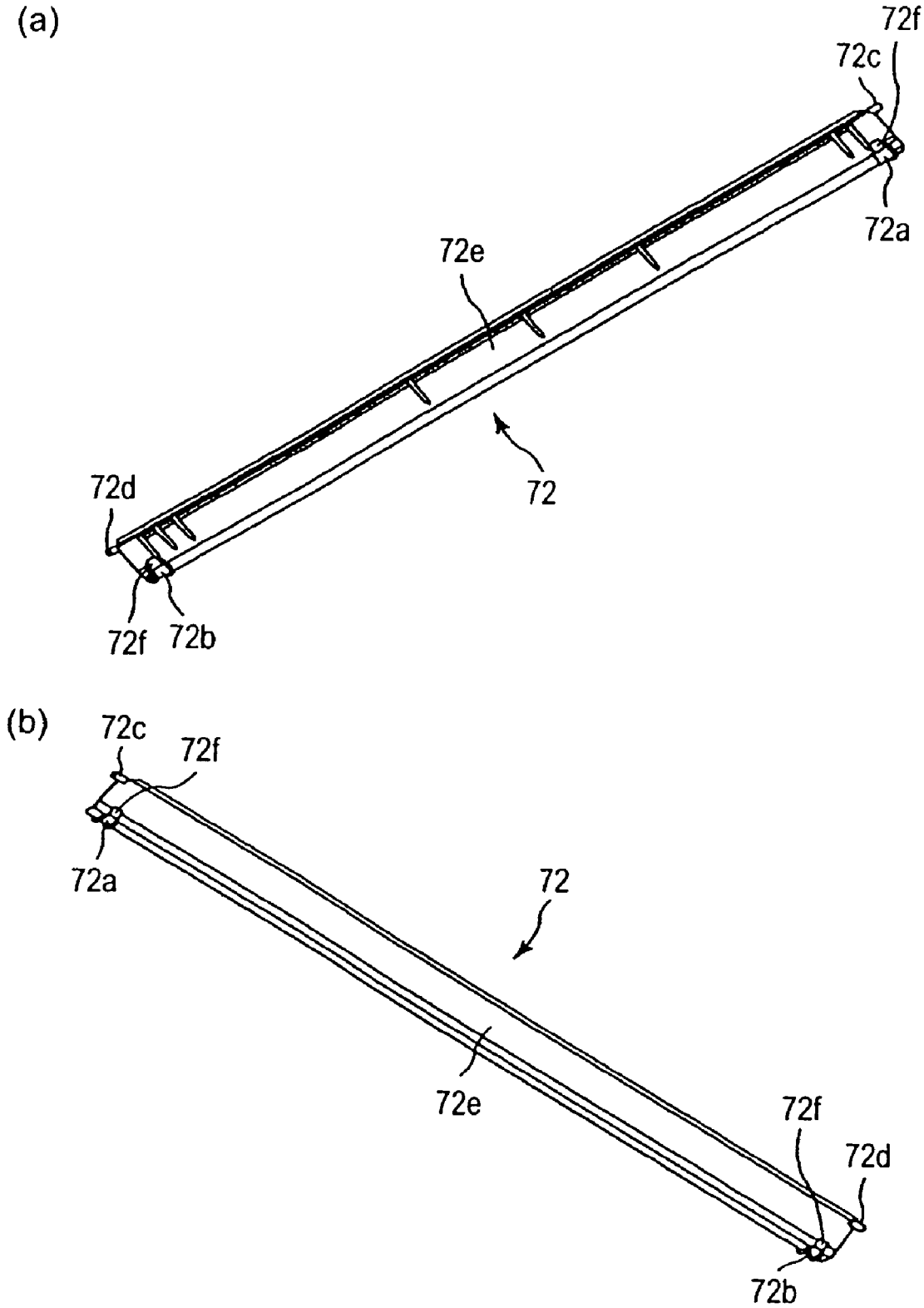
FIG. 7 is a perspective view of a second portion of the drum shutter.

Referring to FIG. 7, the second portion 72 of the shutter 70 is provided with a pair of shafts 72*a* and 72*b*, which are located at the lengthwise parallel to axial line of photosensitive drum 1) end of the portion 72. Referring to FIGS. 3(*a*), 3(*b*), and 5, these shafts 72*a* and 72*b* fit into the grooves 45*c* and 45*d* of the development unit frame, having a U-shaped cross section, allowing the second portion 72 of the shutter 70 to rotate, relative to the development unit frame, about the rotational axis of the shaft 75, or the line connecting the center lines of the shafts 45*c* and 45*d*.

Referring to FIG. 5, in terms of the lengthwise direction (parallel to axial line of photosensitive drum 1) of the shutter 70, the grooves 71*a* and 71*b* of the first portion 71 of the shutter 70 are on the outward side of the shafts 72*a* and 72*b* of the second portion 72 of the shutter 70.

Further, the second portion 72 of the shutter 70 is provided with a pair of connective shafts 72*c* and 72*d*, which are located at the lengthwise ends of the second portion 72, and fit into the aforementioned connective grooves 71*d* and 71*e* of the first portion 71 of the shutter 70. The connective shafts 72*c* and 72*d* control the movement of the second portion 72 of the shutter 70 when the shutter 70 is opened or closed. In terms of the lengthwise direction (parallel to axial line of photosensitive drum 1), the connective shafts 72*c* and 72*d* are located between the grooves 71*a* and 72*b* of the first portion 71 of the shutter 70, and the shafts 72*a* and 72*b* of the second portion 72 of the shutter 70.

With the employment of the above described structural arrangement, the grooves 71*a* and 71*b*, shafts 72*a* and 72*b*, connective grooves 7l*d* and 71*e*, and connective shafts 72*c* and 72*d* can be better positioned in terms of spatial efficiency, making it possible to reduce in size the cartridge 7 and the main assembly of the image forming apparatus.

The shutter 70 is kept under the pressure generated by a pair of return springs 73, as a pressure applying means, so that when the cartridge 7 is out of the apparatus main assembly 100, the drum shutter 70 (71 and 72) completely covers the exposure window 76, through which the photosensitive drum 1 is exposed. The return springs 73 are coil springs. They are attached so that the centers of their torques coincide with the rotational axis of the shaft 74 of the first portion 71 of the shutter 70.

The first portion 71 of the shutter 70 is provided with a pair of rectangular notches 71*g* (first openings) for preventing the first portion 71 of the shutter 70 from interfering with the shafts 45*c* and 45*d* of the development unit frame when the first portion 71 is moved. The second portion 72 of the shutter 70 is provided with a pair of holes 72*f* (second openings) for preventing the second portion 72 from interfering with the shafts 45*c* and 45*d* of the development unit frame when the second portion 72 is opened. Therefore, the first and second portions 71 and 72 of the shutter 70 can be opened widely without interfering with the shafts 45*c* and 45*d*, in other words, very efficiently in terms of spatial efficiency.

Also in terms of the lengthwise direction of the photosensitive drum 1, the shafts 45*c* and 45*d* of the development unit frame are located outward of the range in which a developer image (image formed of developer) is formed. Thus, the ambient light which comes through the rectangular notches 71*g* and holes 72*f* even after the first and second portions 71 and 72 of the shutter 70 are closed, does not affect the area of the peripheral surface of the photosensitive drum 1, across which an electrostatic latent image is formed. This structural arrangement makes it possible to reduce the cartridge size in terms of the lengthwise direction.

(Mechanism for Opening or Closing Drum Shutter)

Next, referring to FIGS. 3(*a*), 3(*b*), 5, and 8(*a*)–8(*c*), the mechanism for opening or closing the drum shutter (which hereinafter may be referred to simply as shutter) will be described. FIG. 5 is a perspective view of the cartridge 7, the drum shutter 70 (71 and 72) of which is fully open. FIGS. 8(*a*)–8(*c*) are drawings which show the three stages "C, D, and E" in the process of opening or closing the drum shutter 70 (71 and 72). FIGS. 8(*a*) and 8(*b*) are perspective views of the drum shutter 70, and FIG. 8(*c*) is a schematic sectional view of the drum shutter 70, showing the relationship between the photosensitive drum 1 and drum shutter 70 (71 and 72).

FIGS. 3(*a*) and 3(*b*) show the cartridge 7, the exposure window 76 (FIG. 2) of which is covered with the drum shutter 70 (71 and 72) which is under the pressure from the return springs 73 (stage "C" in FIGS. 8(*a*)–8(*c*)). Before a user inserts the cartridge 7 into the apparatus main assembly 100, the cartridge 7 is in this state. As the user closes the front door 101 after the insertion of the cartridge 7 into the apparatus main assembly 100, the shutter moving arm 202 (FIG. 12) of the apparatus main assembly 100 is moved in the direction indicated by an arrow mark E in FIG. 12, by the movement of the front door 101. In this embodiment, the shutter moving arm 202 comes into contact with the pin 71*c* of the first portion 71 of the shutter 70, and pushes downward, that is, in the direction indicated by an arrow mark F2 in FIG. 3(*a*), causing thereby the first portion 71 of the shutter 70 to rotate in the clockwise direction about the axial line of the shaft 74 (FIG. 8(*c*)).

The connective shafts 72*c* and 72*d* of the second portion 72 of the shutter 70 are fitted in the connective grooves 71*d* and 71*e* of the first portion 71 of the shutter 70, as described before. Thus, as the first portion 71 of the shutter 70 is rotated in the clockwise direction, the connective shaft 72*c* and 72*d* are moved in the grooves 71*d* and 71*e*, relative to the grooves 71*d* and 71*e*, respectively, in the direction indicated by an arrow mark A (FIG. 8(*b*)), causing thereby the second portion 72 of the shutter 70 to rotate about the axial line of the shaft 75.

As the first portion 71 of the shutter 70 is rotated a certain angle, it rotates the second portion 72 of the shutter 70 by an angle proportional to the angle the first portion 71 rotates (stage "D" in FIG. 8). The axial line of the shaft 74 is parallel to the axial line of the shaft 75. Further, the axial line of the shaft 74 is located on the downstream side of the axial line of the shaft 75, in terms of the rotational direction of the photosensitive drum 1 (upstream side in terms of opening direction of shutter 70). With the provision of the above described structural arrangement, when the shutter 70 is in the closed position in which it covers the exposure window 76 of the development unit frame and cleaner unit frame 51, through which the peripheral surface of the photosensitive drum 1 is exposed, the first portion 71 of the shutter 70 covers the downstream side of the exposure window 76, in terms of the rotational direction of the photosensitive drum 1 (upstream side in terms of opening direction of shutter 70), and the second portion 72 of the shutter 70 covers the upstream side of the exposure window 76 (downstream side in terms of the opening direction of shutter 70 (direction indicated by arrow mark A). However, the first and second portions 71 and 72 of the shutter 70 are made to overlap as the shutter 70 is moved into the open position, in which it exposes the exposure window 76.

When the shutter 70 is in the open position, the flat portions of the first and second portions 71 and 72 of the shutter 70 remain overlapped (stage "E" in FIG. 8, or FIG. 5). By the time the front door 101 is completely closed, the first portion 71 of the shutter 70 will have been rotated roughly 180°. More specifically, the first and second portions 71 and 72 of the shutter 70 overlap so that if the cartridge 7, the drum shutter 70 of which is in the open position, is observed from the direction in which the exposure window 76 faces (direction indicated by arrow mark V1 in FIG. 8(*c*)), the second portion 72 is on the observer side of the second portion 72. Also, it may be said that the first and second portions 71 and 72 of the shutter 70 overlap so that if the cartridge 7, the drum shutter 70 of which is in the opening position, is observed from upstream in terms of the direction in which the cartridge 7 is mounted into the apparatus main assembly 100, the second portion 72 is on the upstream side of the first portion 71.

Thus, the portion of the shutter 70, which is on the observer side if the shutter 70 is seen from the V1 direction, is the flat surface 72*e* of the second portion 72 of the shutter 70. The flat surface 72*e* is the surface of the second portion 72, which faces the peripheral surface of the photosensitive drum 1 when the shutter 70 is in the closed position. In other words, when the shutter 70 is in the open position, the first and second portions 71 and 72 of the shutter 70 overlap so that the flat surface 71*h* of the first portion 71 faces the flat surface 72*e* of the second portion 72. The flat surface 71*h* of the first portion 71 is the surface which faces the peripheral surface of the photosensitive drum 1 when the shutter 70 is in the closed position, and the flat surface 72*e* of the second portion 72 is the surface which constitutes a part of the outward surface of the cartridge 7.

Therefore, not only can the above described structural arrangement for the shutter 70 ensure that the combination of the first and second portions 71 and 72 of the shutter 70 completely covers the exposure window 76 through which the peripheral surface of the photosensitive drum 1 is exposed, but also, it can minimize the space necessary for the drum shutter 70 to move between the aforementioned closed and open positions, making it possible to reduce in size the process cartridge 7. In addition, it can smoothly retract the shutter 70 into a very small space in the main assembly of the image forming apparatus.

As for the movement of the shutter during the opening of the front door 101, as the front door 101 is opened, the aforementioned shutter moving arm 202 of the apparatus main assembly 100 moves in the direction opposite to the direction it moves as the front door 101 is closed. Thus, the drum shutter 70 is moved in the direction opposite to the aforementioned opening direction, by the force generated by the resiliency of the return springs 73. Therefore, the exposure window 76 is completely covered by the drum shutter 70 (71 and 72) by the time the front door 101 is completely closed FIGS. 3(*a*) and 3(*b*)).

The above described drum shutter 70 (71 and 72) is moved by the drum shutter mechanism with which the apparatus main assembly 100 is provided, in order to expose the exposure window 76 of the cartridge 7 through which the photosensitive drum 1 is exposed.

In the case of the above described first embodiment, the pin 71*c* for moving the shutter 70 is a part of the first portion 71 of the shutter 70. If necessary, however, it may be provided as part of the second portion 72, and such an arrangement can achieve the same effects as those achieved when the pin 71*c* is a part of the first portion 71.

As described above, according to this embodiment, as the shutter 70 is opened, the first and second portions 71 and 72 of the shutter 70 are retracted into a very small space in the main assembly of the image forming apparatus, and the above described effects can be achieved by the employment of the drum shutter 70 made up of essentially the first and second portions 71 and 72, making it possible to simplify the mechanism therefor.

(Opening and Closing of Drum Shutter by Drum Shutter Mechanism)

Next, referring to FIGS. 9, 10(*a*), 10(*b*), 11–14, and 15(*a*)–15(*c*), the mechanism, in this embodiment, for opening or closing the drum shutter 70 (71 and 72) will be described.

As described above, each of the cartridges 7 (7*a*, 7*b*, 7*c*, and 7*d*) removably mountable in the main assembly 100 of the image forming apparatus is provided with the drum shutter 70 for covering the exposure window 76 of the cartridge 7 to protect the peripheral surface of the photosensitive drum 1.

In other words, the drum shutter 70 is enabled to move between the closed position in which it covers the exposure window 76 of the cartridge frame, through which the photosensitive drum 1 is exposed, and the open position into which it is moved as the cartridge 7 is mounted into the main assembly 100 of the image forming apparatus. The drum shutter 70 is opened or closed by the drum shutter mechanism.

The drum shutter mechanism in this embodiment is moved by the opening or closing movement of the front door 101 of the apparatus main assembly 100, to which the drum shutter mechanism is connected with the use of a linking means 110. The drum shutter mechanism comprises the linking means 110, a rack 120, and a shutter moving means 200 moved by the rack 120.

Figure 9:
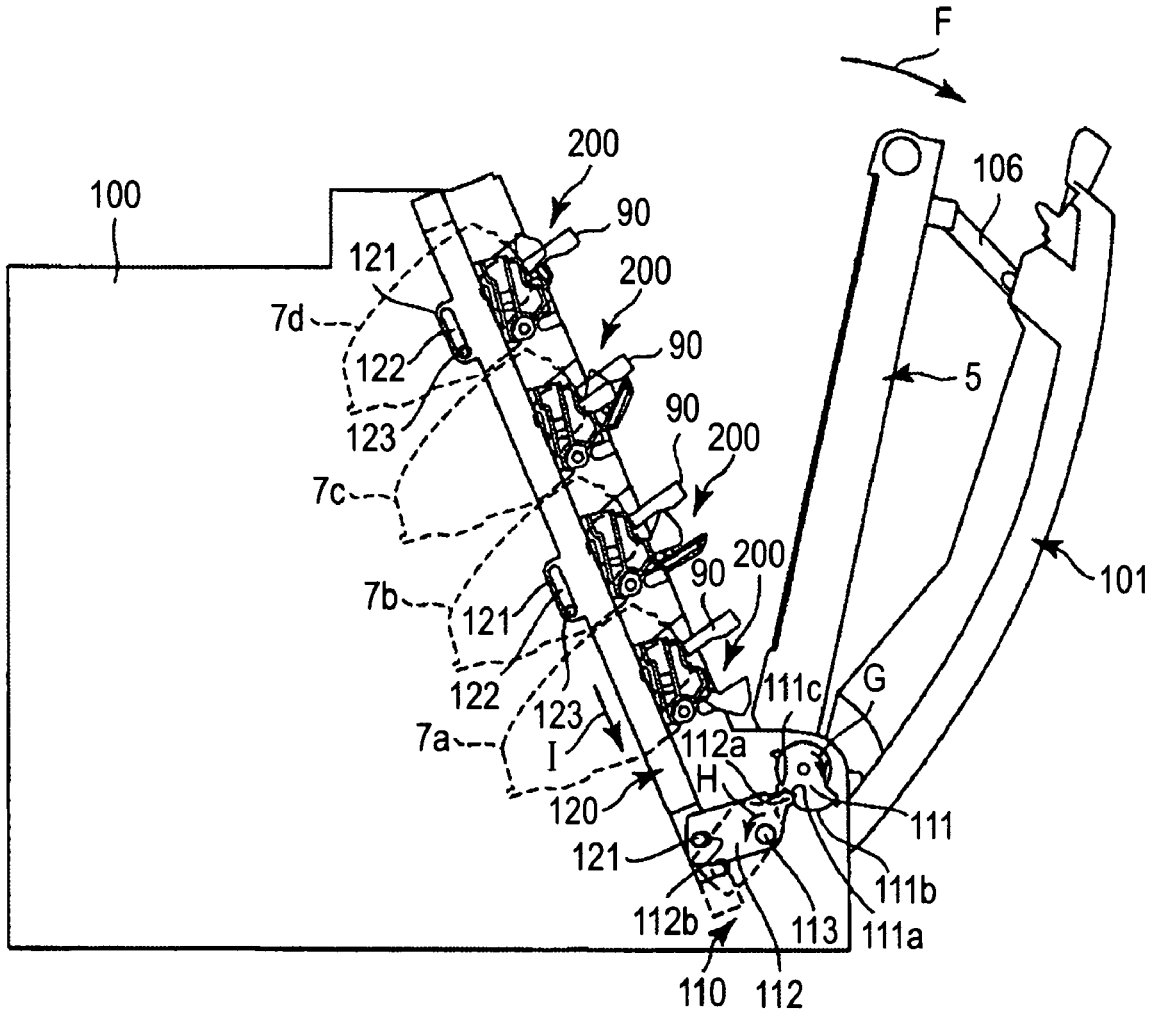
FIG. 9 is a schematic drawing for describing the mechanism of the image forming apparatus in accordance with the present invention, for opening or closing the drum shutter.

Referring to FIG. 9 and FIGS. 10(*a*) and 10(*b*), in this embodiment, the front door 101 and the transferring apparatus 5 are rotatably attached to the apparatus main assembly 100 by their bottom ends with the use of supporting shafts 102 and 103, respectively. Further, the lengthwise top end portions of the front door 101 and transferring apparatus 5 are connected with the use of a pair of arms 106, the ends of which are attached to the front door 101 and electrostatic transferring apparatus 5 with the use of shafts 104 and 105. Thus, the apparatus main assembly 100 the front door 101, the electrostatic transferring apparatus 5, and each of the arms 101, constitute a four joint linkage.

With the provision of the above described structural arrangement, as the front door 101 is closed to the predetermined position (completely closed against apparatus main assembly 100), the transferring apparatus 5 is locked into the predetermined position in which it is precisely positioned relative to each of the cartridges 7 (7*a*, 7*b*, 7*c*, and 7*d*) precisely positioned in the image forming stations Pa–Pd, respectively, of the apparatus main assembly 100, as shown in FIG. 1. On the other hand, as the front door 101 is opened, the transferring apparatus 5 is moved to the position in which it is away from the image forming stations Pa–Pd, as shown in FIG. 9, allowing the right end portion (in FIG. 9) of each of the cartridges 7 (7*a*, 7*b*, 7*c*, and 7*d*) to be exposed.

In this embodiment, the apparatus main assembly 100 is provided with the above described linkage, as the drum shutter moving mechanism, which is moved by the opening or closing movement of the front door 101. This drum shutter moving mechanism, or the linking means 110 comprises: the rack 120 which converts the circular motion of the linking means 110 into vertical rectilinear motion; and the four sets of shutter moving means 200 provided one for each of the image forming stations Pa–Pd to transmit this vertical rectilinear motion to the drum shutters 70 in order to open the shutters 70.

In other words, the drum shutter 70 for covering the exposure window 76 of the photosensitive drum 1 to protect the peripheral surface of the photosensitive drum 1 is opened or closed by the linking means 110, rack 120, and shutter moving means 200.

First, the linking means 110 will be described.

The linking means 110 in this embodiment comprises: a first cam 111 which is rotatably and integrally attached to the supporting shaft 103 of the transferring apparatus 5, in order to convert the rotational motion generated by opening or closing of the front door 101, into vertical rectilinear motion; and a second cam 112 which is moved in an oscillatory manner by the first cam 111. The second cam 112 is attached to the apparatus main assembly 100 with the use of a pin 113, so that it can be moved in an oscillatory manner.

FIG. 9 shows the apparatus main assembly 100, the front door 101 of which is roughly half opened before the front door 101 is fully opened or fully closed. This state can be maintained because the projection 112*a* of the second cam 112, which is located at one of the lengthwise ends of the second cam 112, a predetermined distance away from the pin 113, is fitted in the recess 111*a* made in the peripheral surface of the first cam 111. The second cam 112 is provided with an elongated hole 112*b* which is located on the opposite side of the pin 113 from the projection 112*a*, and in which a pin of the rack 120 is fitted. The pin will be described later in detail.

Figure 12:
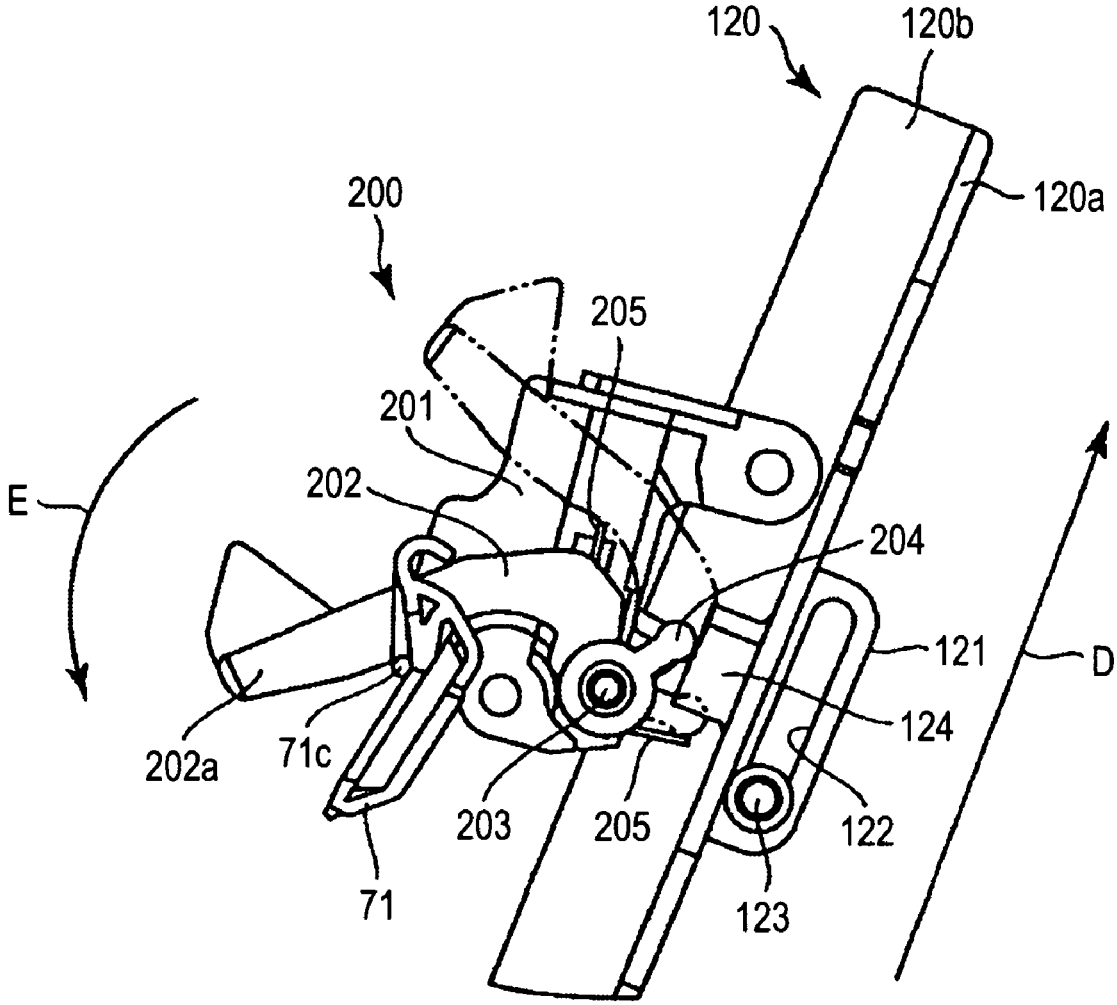
FIG. 12 is a schematic drawing for describing the mechanism of the image forming apparatus in this embodiment, for opening or closing the drum shutter.

The rack 120 vertically extends along the plurality of image forming stations Pa–Pd vertically stacked in parallel. Referring to FIG. 12, the rack 120 is formed by bending a piece of plate, and comprises a long and narrow bottom portion 120*a*, and a side portion 120*b* perpendicular to the bottom portion 12*a*. In other words, the rack 120 is an angled member, or a member with a cross section in the form of an L.

The rack 120 (120*a* and 120*b*) is positioned parallel to the direction in which the cartridges 7 (7*a*, 7*b*, 7*c*, and 7*d*) are stacked in parallel in the apparatus main assembly 100; in other words, it is positioned slightly tilted relative to the true vertical direction. The bottom portion 120*a* of the rack 120 is provided with a pair of supporting plates 121, which are integrally attached to the bottom portion 120*a*. Each bottom portion 120*a* has an elongated groove (hole) 122, in which the supporting pin 123 is fitted to allow the rack 120 to be moved relative to the apparatus main assembly 100.

The rack 120 converts the torque transmitted thereto from the front door 1 through the first and second cam 111 and 112, into the vertical rectilinear force, and transmits it to the four color image forming stations Pa–Pd.

Next, referring to FIGS. 12 and 13, the shutter moving means 200 for transmitting the force from the rack 120 to the drum shutter 70 will be described. FIG. 12 is a side view of the shutter moving means 200 as seen from inside the apparatus main assembly 100, and FIG. 13 is a perspective view of the shutter moving means 200 as seen from the cartridge insertion opening of the apparatus main assembly 100.

Figure 13:
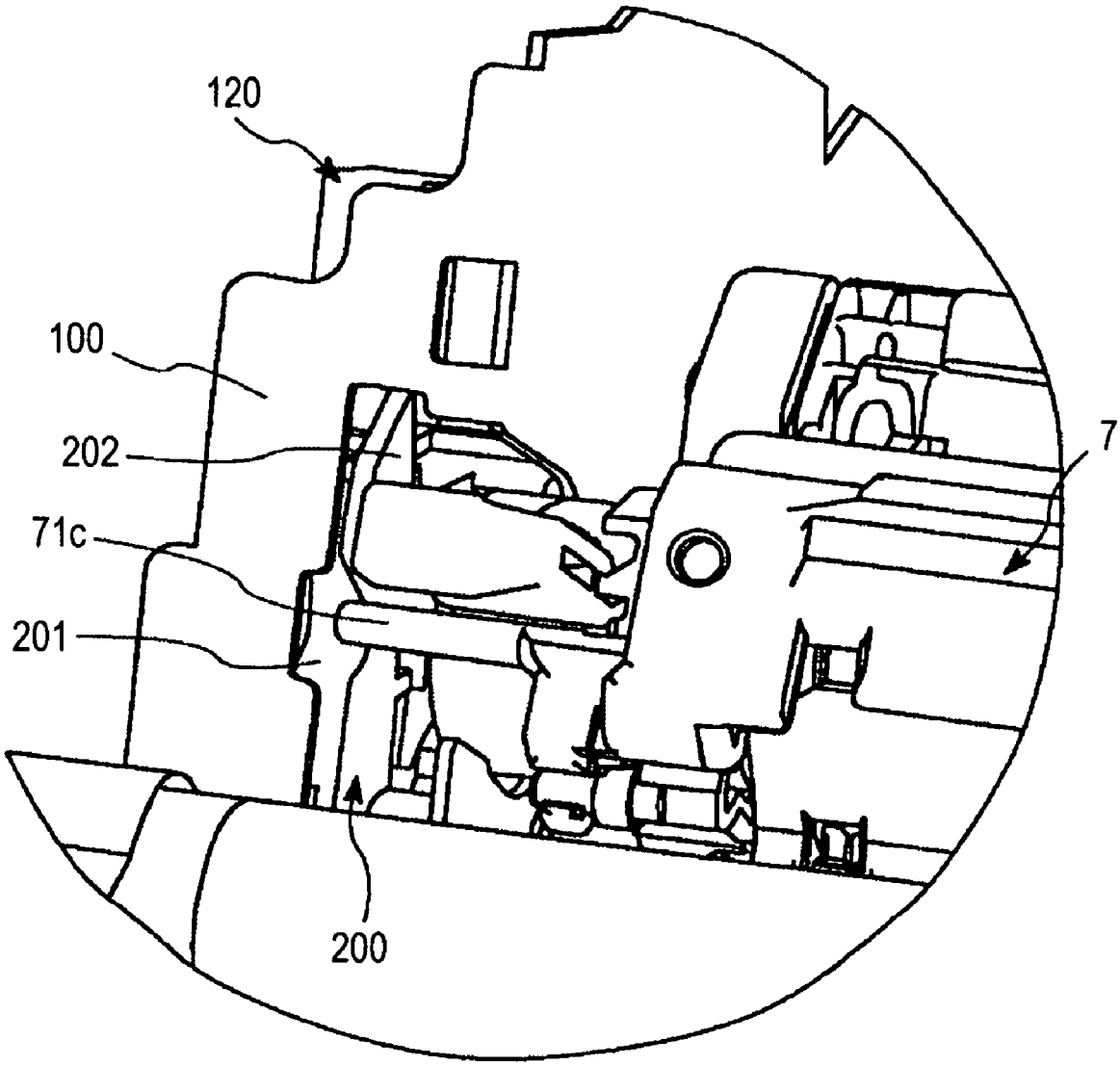
FIG. 13 is a perspective view of the mechanism of the image forming apparatus in accordance with the present invention, for opening or closing the drum shutter, and one of the lengthwise ends of the process cartridge, as seen from the cartridge insertion opening side of the apparatus main assembly.

Referring to FIGS. 12 and 13, the shutter moving means 200 has a base member 201 attached to the apparatus main assembly 100 with the use of screws (unshown) or the like. Around the shaft 203 of the base member 201, the aforementioned shutter moving member 202 is fitted so that the shutter moving member 202 can be rotated about the shaft 203 in an oscillatory manner. The shutter moving member 202 is in the form of a long and narrow arm, one of the lengthwise ends of which denoted by 202*a*, extends toward the drum shutter 70. In this embodiment, the lengthwise end 202*a* of the shutter moving arm 202 extends beyond the pin 710 of the first portion 71 of the shutter 70, which is pressed by the shutter moving arm 202. The shutter moving arm 202 is rotated by the force applied thereto by the movement of the front door in the direction indicated by an arrow mark F2 in FIG. 3(*a*). As a result, the shutter moving arm 202 presses down the pin 71*c* of the first portion 71 of the shutter 70, moving thereby the first portion 71.

The shutter moving arm 202 is also provided with a projection 204 which is integral with the arm 202 and functions as a cam. The projection 204 is enabled to engage with a cam member 124 with which the aforementioned bottom portion 120*a* of the rack 120 is provided.

The shutter moving member 202 is kept pressured in the clockwise direction of FIG. 12, by a return coil spring 205, as a pressure applying member, fitted around the shaft 203, so that unless external force is applied to the shutter moving member 202, the shutter moving member 202 will move back into the home position contoured by a double-dot chain line in FIG. 12, that is, the position in which it allows the shutter 70 to cover the exposure window 76 through which the photosensitive drum 1 is exposed.

Next, the movement of the shutter moving means 200 in this embodiment structured as described above will be described.

For the purpose of making it easier to understand the movement, the case (FIG. 9) in which the front door 101 is completely opened from the position in which it is roughly half open, and the case (FIG. 11) in which the front door 101 is completely closed against the apparatus main assembly 100 from the position in which it is roughly half open, will be described.

When the front door 101 is in the state shown in FIG. 9, the projection 112*a* of the second cam 112 is in the recess 111*a* of the first cam 111.

First, referring to FIG. 11, the movement of the shutter moving means 200 which occurs as the front door 101 of the image forming apparatus is closed after the mounting of the cartridges 7 into the apparatus main assembly 100 will be described. The state of the front door 101 in FIG. 11 is the same as that in FIG. 9.

Figure 11:
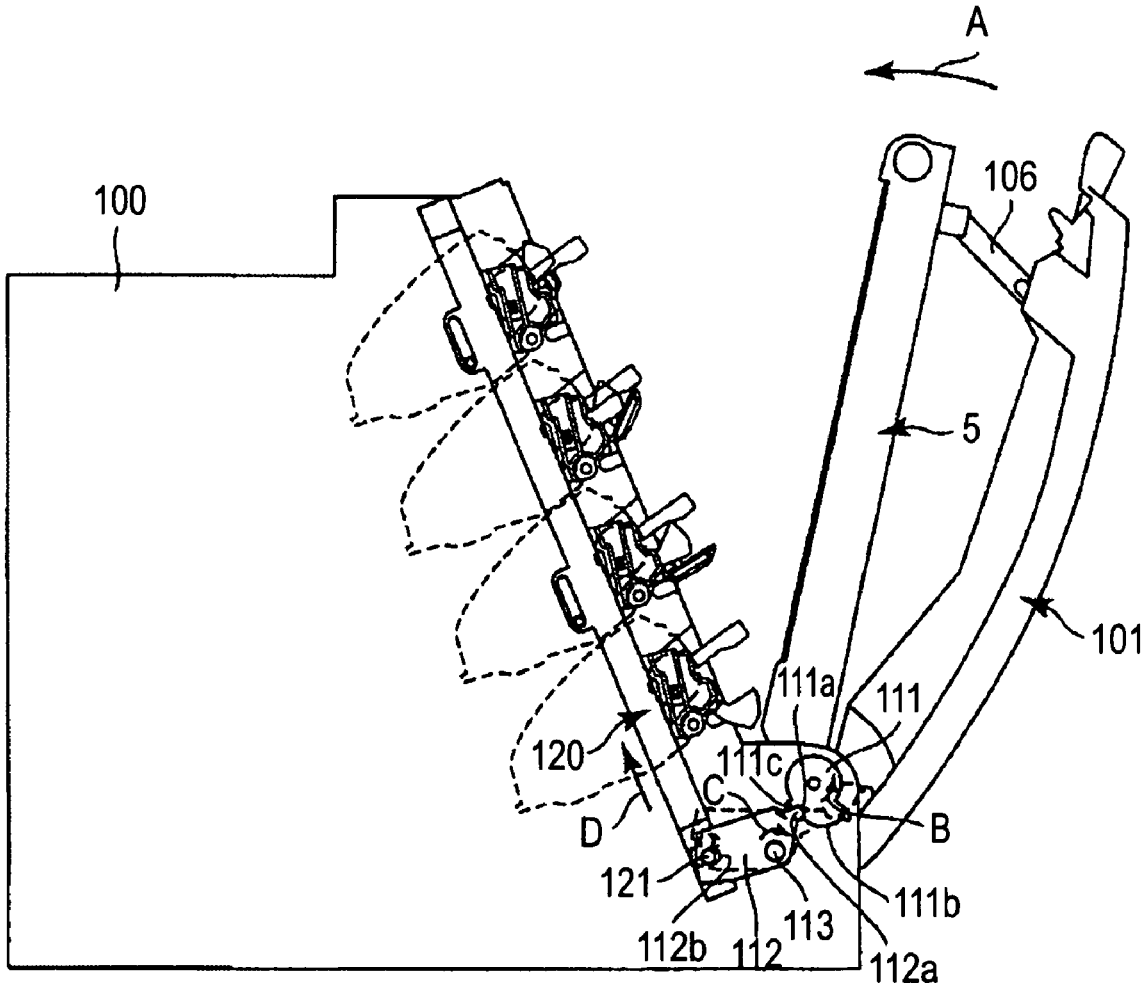
FIG. 11 is a schematic drawing for describing the mechanism of the image forming apparatus in accordance with the present invention, for opening or closing the drum shutter.

As the front door 101 is rotated in the counterclockwise direction (the direction indicated by arrow mark A) of FIG. 11 in order to close the front door 101, the transferring apparatus is rotated counterclockwise with the front door 101, causing, therefore, the first cam 111 to rotate in the clockwise direction (direction indicated by arrow mark B).

As a result, the projection 111*c* of the first cam 111, which is located downstream of the recess 111*a* of the first cam 111 in terms of the rotational direction of the photosensitive drum 1 (the upstream direction in terms of the shutter opening direction), comes into contact with the projection 112*a* of the second cam 112. Thus, as the first cam 111 is further rotated, the second cam 112 is rotated in the clockwise direction (indicated by arrow mark C) about the pin 113.

This clockwise rotation of the second cam 112 causes the pin 121 of the rack 120, which is in the elongated hole 112*b* of the second cam 112, to be pushed up. As a result, the rack 120 is moved upward (direction indicated by arrow mark D).

This upward movement of the rack 120 causes the cam 204 of the shutter moving arm 202 to move onto the projection 124 of the rack 120, causing the shutter moving arm 202 to rotate in the direction indicated by an arrow mark E in FIG. 12, about the shaft 203.

As the result of this rotational movement of the shutter moving arm 202, the shutter moving member 202 comes into contact with the pin 71 of the first portion 71 of the shutter 70. Then, as the shutter moving arm 202 is further rotated in the counterclockwise direction, the pin 71 is moved downward.

Figure 15:
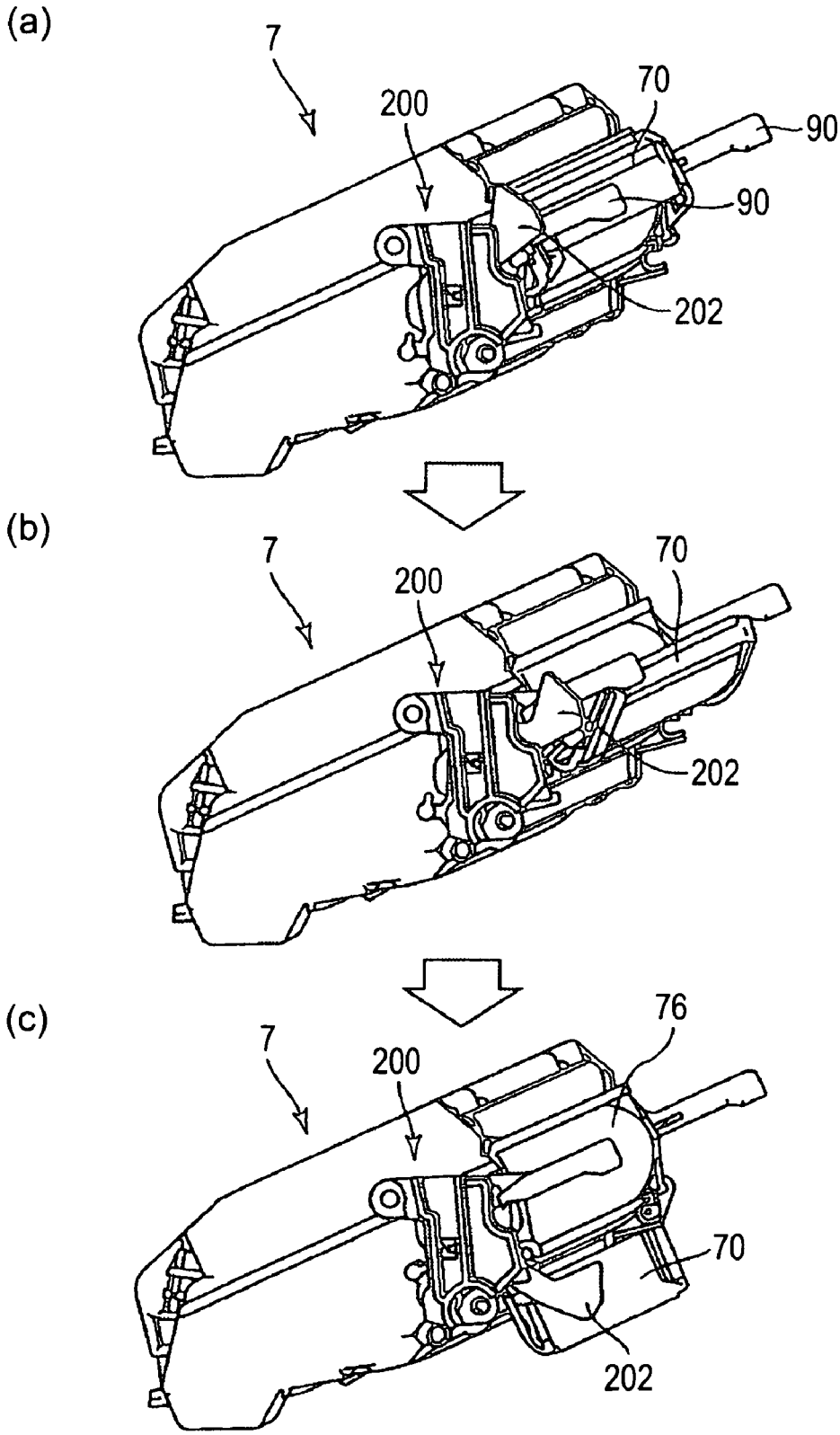
FIGS. 15(*a*)–15(*c*) are perspective views for describing the opening and closing movements of the drum shutter of the process cartridge in accordance with the present invention.

As a result, the drum shutter 70 (71 and 72) is opened as shown in FIGS. 5 and 15(*c*), exposing therefore the exposure window 76 of the cartridge 7 through which the photosensitive drum 1 is exposed. By the time the drum shutter 70 is completely opened as shown in FIGS. 5 and 15(*c*), the electrostatic transfer belt 11 will have been moved into the predetermined position, shown in FIG. 1, in which it is ready for image formation.

Next, referring to FIG. 9, the movement of the shutter moving arm 202 which occurs when the front door 101 of the image forming apparatus is opened will be described.

As the front door 101, which is fully open as shown in FIG. 1, is moved in the clockwise direction (direction of arrow mark F) to open the front door 101 (FIG. 9), the transferring apparatus 5 is rotated with the front door 101 also in the clockwise direction, causing the first cam 111 to rotate in the clockwise direction (indicated by arrow mark G). Therefore, the second cam 112 is rotated in the counterclockwise direction (indicated by arrow mark H).

As a result, the projection 112*a* of the second cam 112 fits into the recess 111*a* of the first cam 111, as shown in FIG. 9.

Then, as the first cam 111 is further rotated, the projection 112*a* of the second cam 112 is made to come into contact with the actual cam portion 111*b* of the first cam 111, causing the second cam 112 to rotate about the pin 113 in the counterclockwise direction.

This counterclockwise rotation of the second cam 112 causes the second cam 112 to push down the pin 121 of the rack 120, which is in the elongated hole 112*b* of the second cam 112, causing the rack 120 to move downward (direction indicated by arrow mark I).

Figure 14:
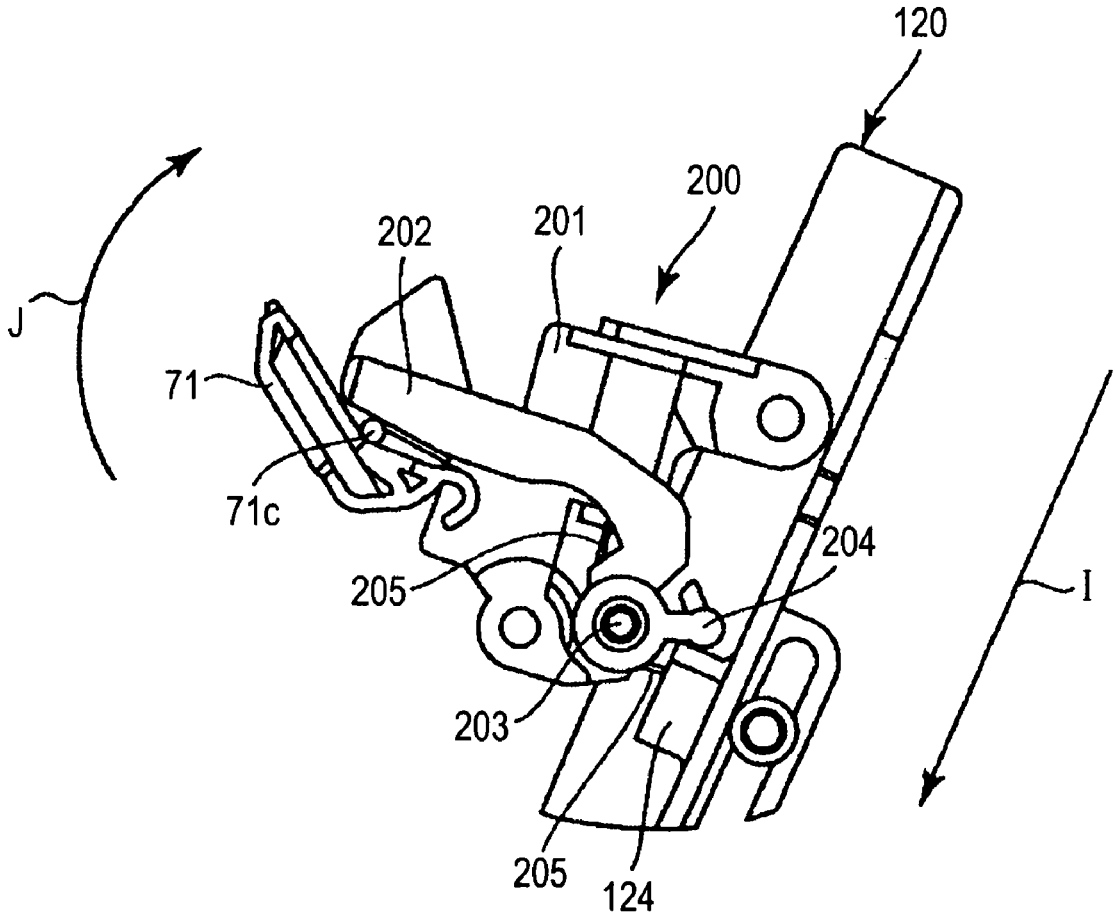
FIG. 14 is a drawing for describing the mechanism of the image forming apparatus in accordance with the present invention, for opening or closing the drum shutter.

This downward movement of the rack 120 disengages the projection 124 of the rack 120 from the cam 204 of the shutter moving arm 202, which has been moved onto the projection 124 of the rack 120. Thus, the shutter moving arm 202 is rotated in the clockwise direction (indicated by arrow mark J), as shown in FIG. 14, by the force generated by the resiliency of the return coil spring 205 attached to the shutter moving arm 202.

This rotational movement of the shutter moving arm 202 eliminates the force which applies to the pin 71*c* of the first portion 71 of the shutter 70 in the direction to move the pin 71*c* downward (arrow direction F in FIG. 3). As a result, the drum shutter 70 (71 and 72) is closed by the force generated by the resiliency of the return spring 205, as shown in FIGS. 2, 3, and 15(*a*), covering the exposure window 76 of the cartridge frame, through which the photosensitive drum 1 is exposed.

As described above, as the drum shutter 70 (comprising two portions 71 and 72), which is covering the exposure window 76, is opened, the two portions 71 and 72 of the shutter 70 are overlapped as they are retracted into the apparatus main assembly 100, making it possible to retract the shutter 70 into a very small space in the apparatus main assembly 100. Therefore, it is possible to reduce in size the main assembly of the image forming apparatus.

More specifically, referring to FIG. 1, the drum shutter 70 of the cartridge 7*d* can be retracted into a minute space between the developing apparatus 4*d* and electrostatic transferring belt 11. In other words, the direction in which the drum shutter 70 is opened is such a direction that as the shutter 70 is opened, it is placed closer to the development roller 40. Thus, after the mounting of the cartridge 7*d* into the apparatus main assembly 100, the drum shutter 70 is below the photosensitive drum 1.

Therefore, it is possible to reduce the distance between the photosensitive drums 1 in the adjacent two process cartridges, which in turn makes it possible to reduce the height of the apparatus main assembly 100. As will be evident from the above description of the preferred embodiment of the present invention, the present invention is most effective when applied to a multicolor image forming apparatus. However, because the present invention makes it possible to retract the drum shutter into a minute space, it is also effective when applied to an image forming apparatus which employs only a single photosensitive drum.

Also as described above, the drum shutter moving mechanism of the apparatus main assembly 100 is required to act on only one of the two portions of the shutter, and the other portion is rotated by the rotational movement of the first portion. Therefore, it is possible to simplify the shutter moving mechanism of the apparatus main assembly 100.

Further, the drum shutter 70 is made up of essentially two portions, both of which are rotationally moved as the drum shutter 70 is opened or closed. Therefore, the drum shutter 70 in accordance with the present invention is substantially smaller in rotational radius than a drum shutter in accordance with the prior art. Therefore, it is much shorter in the stroke of the drum shutter moving member on the main assembly side of an image forming apparatus. Therefore, the drum shutter 70 in accordance with the present invention is convenient for the purpose of reducing the size of the image forming apparatus.

Further, the first portion of the drum shutter is provided with the connective grooves for guiding the second portion of the drum shutter, and the second portion of the drum shutter is provided with the connective shafts which fit into the connective grooves of the first portion. Therefore, the connection between the first and second portions of the drum shutter, and the controlling of the movement of the second portion, can be accomplished by the single setup, making it possible to simplify in structure the drum shutter.

Further, the rotational axis of the first portion of the drum shutter is on the downstream side of the rotational axis of the second portion of the shutter, in terms of the rotational direction of the photosensitive drum (upstream side in terms of opening direction of shutter 70). In other words, in terms of the rotational direction, the two rotational axes are positioned in the same order as the first and second portions of the drum shutter (indicated by arrow mark R), making it possible to make the two portions of the drum shutter efficiently overlap.

Further, the drum shutter is made up of only the two portions of the drum shutter, the sizes of which are half the size of a drum shutter in accordance with the prior art, and the pair of return springs. In other words, the component count of the drum shutter is minimized, making it possible to retract the drum shutter into a very small space, without incurring cost increase.

The present invention ensures that a photosensitive drum can be perfectly covered by the first and second portions of a drum shutter, and minimizes the space necessary for the drum shutter to move between the closed position and open position, making it possible to reduce in size a process cartridge and an electrophotographic image forming apparatus. Further, the present invention makes it possible that as the drum shutter is opened to expose the electrophotographic photosensitive drum from the cartridge frame, it compactly retracts into the main assembly of the electrophotographic image forming apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 106511/2004 and 289303/2004 filed Mar. 31, 2004 and Sep. 30, 2004, respectively, which are hereby incorporated by reference.

What is claimed is:

1. A process cartridge detachably mountable to a main assembly of an electrophotographic image forming apparatus, said process cartridge comprising:

an electrophotographic photosensitive drum;

a process device actable on said electrophotographic photosensitive drum;

a cartridge frame;

a drum shutter movable between a close position in which said drum shutter covers an exposed portion of said electrophotographic photosensitive drum which is exposed through said cartridge frame and an open position in which said drum shutter is retracted from the close position to expose the portion of said electrophotographic photosensitive drum, said drum shutter having a first shutter portion rotatably supported on said cartridge frame and a second shutter portion rotatably supported on said cartridge frame, wherein in the close position, said first shutter portion covers an upstream side of said exposed portion with respect to an opening direction in which said drum shutter moves from the close position to the open position, and the second shutter portion covers a downstream side of the exposed portion with respect to the opening direction, wherein the downstream side of the exposed portion is downstream of the upstream side of the exposed portion, and wherein in the open position, said first shutter portion and said second shutter portion overlap each other in the widthwise direction of said drum shutter.

2. A process cartridge according to claim 1, wherein said cartridge has a first supporting portion configured and positioned to rotatably support said first shutter portion and a second supporting portion configured and positioned to rotatably support said second shutter portion, and wherein said first supporting portion is disposed upstream of said second supporting portion with respect to the opening direction.

3. A process cartridge according to claim 1, wherein said cartridge frame includes a first supporting portion configured and positioned to rotatably support said first shutter portion and a second supporting portion configured and positioned to rotatably support said second shutter portion, and wherein said first supporting portion and said second supporting portion are disposed at different positions with respect to a direction of an axis of said electrophotographic photosensitive drum.

4. A process cartridge according to claim 3, wherein said first supporting portion is disposed outside said second supporting portion with respect to the direction of the axis.

5. An apparatus according to claim 4, wherein said second supporting portion is disposed outside a region where a developed image is formed on a peripheral surface of said electrophotographic photosensitive drum, with respect to the direction of the axis.

6. An apparatus according to claim 1, wherein said cartridge frame includes a first supporting portion configured and positioned to rotatably support said first shutter portion and a second supporting portion configured and positioned to rotatably support said second shutter portion, and wherein in interrelation with a rotating operation of one of said first shutter portion and said second shutter portion, the other one of said first shutter portion and said second shutter portion is rotated.

7. A process cartridge according to claim 6, wherein said first shutter portion includes an engaging portion configured and positioned to engage said second shutter portion and wherein said engaging portion moves when said first shutter portion rotates relative to said cartridge frame.

8. A process cartridge according to claim 7, wherein said engaging portion includes a connection groove configured and positioned to guide a connecting shaft provided on said second shutter portion.

9. A process cartridge according to claim 7, wherein said first supporting portion, said engaging portion and said second supporting portion are disposed in the order named, from outside to inside of said process cartridge with respect to the direction of the axis of said electrophotographic photosensitive drum.

10. A process cartridge according to claim 1, wherein when said process cartridge is mounted to the main assembly of the image forming apparatus, said drum shutter is contacted by engaging means provided in the main assembly of the image forming apparatus to move said drum shutter from the close position to the open position.

11. A process cartridge according to claim 10, wherein said drum shutter is contacted by the engaging means at a cartridge contact portion and wherein said cartridge contact portion is provided in said first shutter portion.

12. A process cartridge according to claim 1, wherein in said open position, said first shutter portion is behind said second shutter portion as said process cartridge is seen in a direction in which said exposed portion is seen.

13. A process cartridge according to claim 1, wherein the direction of opening said drum shutter is such that said drum shutter approaches a developing roller configured and positioned to develop an electrostatic latent image formed on said electrophotographic photosensitive drum, wherein said process device comprises said developing roller.

14. A process cartridge according to claim 3, wherein said first shutter portion has a first opening which said second supporting portion enters in said open position.

15. A process cartridge according to claim 3, wherein said second shutter portion has a second opening which said second supporting portion enters in said open position.

16. An apparatus according to claim 1, wherein in said open position, said drum shutter is below said electrophotographic photosensitive drum in a state in which said process cartridge is mounted to the main assembly of said image forming apparatus.

17. An electrophotographic image forming apparatus for forming an image on a recording material, wherein a process cartridge is detachably mountable to said electrophotographic image forming apparatus, said electrophotographic image forming apparatus comprising:

(a) a mounting device configured and positioned to detachably mount the process cartridge, the process cartridge including, an electrophotographic photosensitive drum, a process device actable on the electrophotographic photosensitive drum, a drum shutter movable between a close position in which the drum shutter covers an exposed portion of the electrophotographic photosensitive drum which is exposed through the cartridge frame and an open position in which the drum shutter is retracted from the close position to expose the portion of the electrophotographic photosensitive drum, the drum shutter having a first shutter portion rotatably supported on the cartridge frame and a second shutter portion rotatably supported on the cartridge frame, wherein in the close position, the first shutter portion covers an upstream side of the exposed portion with respect to an opening direction in which the drum shutter moves from the close position to the open position, and the second shutter portion covers a downstream side of the exposed portion with respect to the opening direction, wherein the downstream side of the exposed portion is downstream of the upstream side of the exposed portion, and wherein in the open position, the first shutter portion and the second shutter portion overlap each other in the widthwise direction of the drum shutter; and (b) a feeding device configured and positioned to feed the recording material.

18. An apparatus according to claim 17, further comprising:

an openable member which is movable between a closing position in which an insertion opening for permitting passage of the process cartridge is closed and an open position in which the insertion opening is open, when the process cartridge is mounted to the main assembly of said image forming apparatus; and an engaging device configured and positioned to move in interrelation with said openable member, said engaging device being effective to move the drum shutter from the close position to the open position by abutting to a cartridge contact portion provided in the process cartridge when the process cartridge is mounted to the main assembly of said image forming apparatus.

19. An apparatus according to claim 17, wherein said electrophotographic image forming apparatus is a color electrophotographic image forming apparatus in which a plurality of the process cartridges are arranged substantially along a vertical line when they are mounted.

20. A process cartridge according to claim 14, wherein the second shutter portion has a second opening which the second supporting portion enters in the open position.

* * * * *